US009272198B2

(12) United States Patent
Brenner

(10) Patent No.: US 9,272,198 B2
(45) Date of Patent: Mar. 1, 2016

(54) TRAINING STAND

(71) Applicant: Patricia Brenner, Encino, CA (US)

(72) Inventor: Patricia Brenner, Encino, CA (US)

(73) Assignee: HICO INC., Encino, CA (US)

( * ) Notice: Subject to any disclaimer, the term of this patent is extended or adjusted under 35 U.S.C. 154(b) by 0 days.

(21) Appl. No.: 13/663,275

(22) Filed: Oct. 29, 2012

(65) Prior Publication Data

US 2013/0059699 A1 Mar. 7, 2013

Related U.S. Application Data

(63) Continuation-in-part of application No. 13/185,317, filed on Jul. 18, 2011, now Pat. No. 8,298,124, which is a continuation of application No. 12/235,262, filed on Sep. 22, 2008, now Pat. No. 7,981,009.

(60) Provisional application No. 60/975,984, filed on Sep. 28, 2007, provisional application No. 61/704,843, filed on Sep. 24, 2012.

(51) Int. Cl.

| | |
|---|---|
| ***A63B 21/00*** | (2006.01) |
| ***A63B 69/34*** | (2006.01) |
| ***A63B 69/00*** | (2006.01) |
| *A63B 71/02* | (2006.01) |

(52) U.S. Cl.

CPC ..... *A63B 69/34* (2013.01); *A63B 69/004* (2013.01); *A63B 2071/026* (2013.01); *A63B 2210/50* (2013.01); *A63B 2225/09* (2013.01); *A63B 2225/093* (2013.01)

(58) Field of Classification Search

USPC ..... 482/83, 90, 87, 907, 35

See application file for complete search history.

(56) References Cited

U.S. PATENT DOCUMENTS

| | | | | |
|---|---|---|---|---|
| 4,486,016 | A | 12/1984 | Rubin | |
| 4,991,231 | A | 2/1991 | Swift | |
| 5,460,343 | A | 10/1995 | Hestilow | |
| 5,503,356 | A | 4/1996 | Shelby | |
| 5,722,920 | A | 3/1998 | Bauer | |
| 5,863,278 | A * | 1/1999 | Chen | 482/83 |
| 5,899,835 | A | 5/1999 | Puranda | |
| 6,220,992 | B1 * | 4/2001 | Shafik | 482/83 |
| 6,348,028 | B1 * | 2/2002 | Cragg | 482/148 |
| 6,736,764 | B1 | 5/2004 | Kapustka | |
| 7,993,249 | B1 * | 8/2011 | Fassl et al. | 482/83 |
| 2002/0193211 | A1 | 12/2002 | Kao | |
| 2005/0181914 | A1 | 8/2005 | Radkowski et al. | |
| 2005/0250624 | A1 | 11/2005 | Yu | |
| 2007/0197348 | A1 | 8/2007 | Ku | |
| 2007/0197350 | A1 | 8/2007 | Gonzalez | |
| 2008/0220949 | A1 * | 9/2008 | Yang | 482/90 |
| 2009/0247374 | A1 | 10/2009 | Chen | |

* cited by examiner

*Primary Examiner* — Jerome w Donnelly

(74) *Attorney, Agent, or Firm* — Loza & Loza, LLP; Julio M. Loza

(57) ABSTRACT

A nestable training stand is provided. The stand includes a central frame member having upper and lower portions; and a base operatively coupled to the lower portion. The base comprises a U-shaped or V-shaped base member having first and second end portions; and a support member connected to and extending upwardly from the first and second end portions to the central frame member. One or more upper and/or lower weight support pins are coupled to the support member and central frame, respectively, and extend outward for holding weights to prevent the stand from moving. The central frame support may include a bend between a first point where it couples to the U-shaped or V-shaped base member and a second point where it couples to support member to shift the center of gravity of the stand backwards.

19 Claims, 24 Drawing Sheets

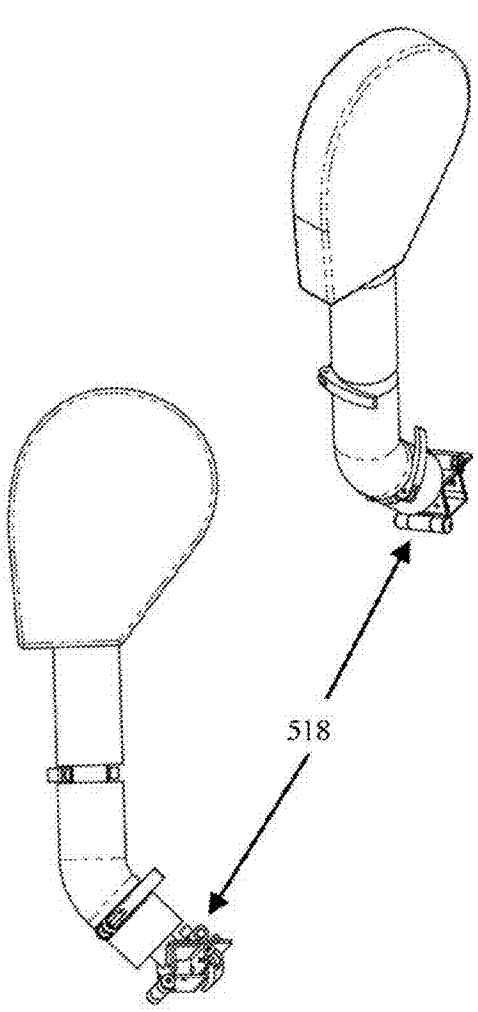
FIGURE 20
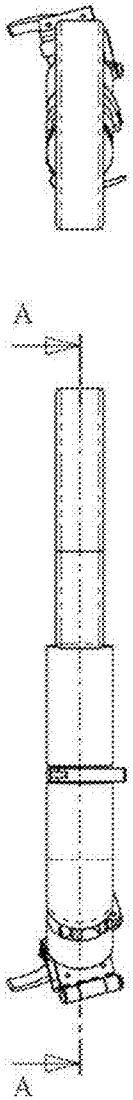
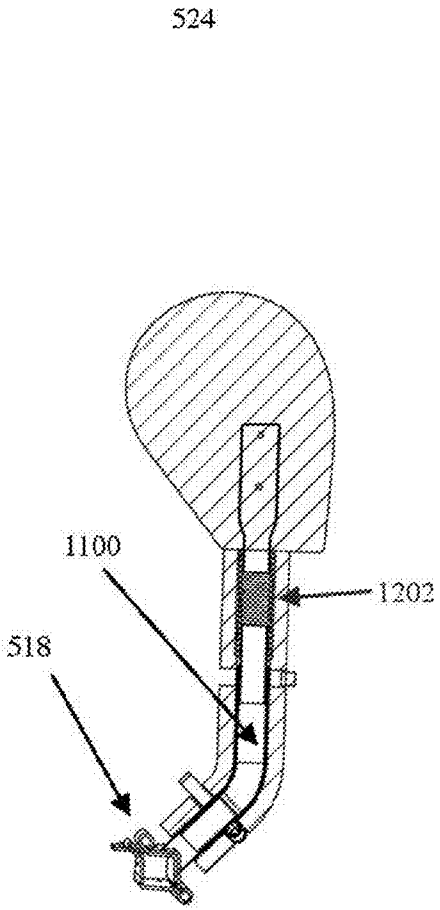
SECTION A-A

TRAINING STAND

PRIORITY CLAIM

This application claims the benefit of U.S. Provisional Application Ser. No. 61/704,843 filed Sep. 24, 2012, and is a continuation-in-part application of, U.S. Ser. No. 13/185,317, filed Jul. 18, 2011, and entitled Strike Targets For Training Stand, which claims priority to and is a continuation application of, U.S. Ser. No. 12/235,262, filed Sep. 22, 2008, and entitled Collapsible Training Stand, which claims priority to U.S. Provisional Application Ser. No. 60/975,984 filed Sep. 28, 2007.

FIELD

Various features pertain to stands used for self-defense training, in particular to portable devices for practicing punching and kicking offensive and defensive techniques by hitting various pads or targets.

BACKGROUND

In the realm of exercise equipment, punching and/or kicking bags and targets are commonplace. Existing stands are designed to withstand punching and kicks and as a result tend to be bulky and/or permanent fixtures. As such, existing stands are not easy to move to different locations and are not easy to store away when not in use.

Additionally, users tend to be of different heights and have different exercise needs (e.g., punching versus kicking exercises, martial arts versus boxing, etc.). However, many existing punching and kicking exercise equipment are not easily adjustable to accommodate these needs.

One type of prior art portable exercise device for training self defense includes a large hollow base that is filled with water or sand to make it stable when kicking or punching the pads or targets. Such devices are typically very heavy after filled with water and sand and as a result they are difficult to store or move from one location to another.

Another type of prior art portable exercise device for training self-defense includes a human torso and head shape for practicing punching or kicking techniques. Such devices are not adjustable in the height or position of the head and torso, and as a result may not be appropriately sized for very tall or short people, or practicing techniques for a variety of human sizes.

Consequently, a portable stand for training self defense is needed that is stable, easily stored, moved around and easily adjustable over a range of heights and positions.

SUMMARY OF THE INVENTION

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

According to one embodiment, a nestable training stand is provided. The training stand includes a central frame member having an upper portion and a lower portion; and a base operatively coupled to the lower portion of the central frame member. The base comprises a U-shaped or V-shaped base member having a first end portion and a second end portion; and a support member connected to and extending upwardly from the first and second end portions of the base member to the central frame member. The training stand further includes one or more upper weight support pins coupled to the support member and extending outward from the training stand.

The support member may have the same or similar shape of the base member and comprise a pair of side supports that are connected to the first and second end portions of the base member and a top support member that is integrally connected to the pair of side supports and coupled to the central frame member. One or more lower weight support pins may be coupled to the central frame member between the U-shaped or V-shaped base and the pair of side supports.

The central frame support may include a bend between a first point where it couples to the U-shaped or V-shaped base member and a second point where it couples to the pair of side supports. The bend shifts the center of gravity of the training stand backwards.

One or more wheels may be coupled to a front portion of the U-shaped or V-shaped bottom base member to permit tilting and rolling of the training stand.

Additionally, the training stand further includes a horizontal support shaft coupled to the central support shaft. A plurality of strike pads may be movably coupled to the horizontal support shaft and the horizontal support shaft may serve to support one or more adjustable focus pads.

Furthermore, the central frame member and the base of the training stand may be formed to at least partially receive a second central frame member and a second base of a second training stand allowing for nesting a plurality of training stands.

These and other aspects of the disclosure will become more fully understood upon a review of the detailed description, which follows.

BRIEF DESCRIPTION OF THE DRAWINGS

Various features, nature and advantages may become apparent from the detailed description set forth below when taken in conjunction with the drawings in which like reference characters identify correspondingly throughout.

FIG. 20 illustrates various views of an embodiment of a hand target may be positioned on the training stand of FIG. 1 or FIG. 9.

DETAILED DESCRIPTION OF THE INVENTION

In the following detailed description of the invention, numerous specific details are set forth in order to provide a thorough understanding of the invention. However, the invention may be practiced without these specific details. In other instances well known methods, procedures, and/or components have not been described in detail so as not to unnecessarily obscure aspects of the invention.

One aspect of the present invention provides a training device for hitting and kicking exercises, where the device comprises a training stand and a plurality of horizontally adjustable and vertically adjustable targets (e.g., punching/kicking targets).

The training stand may be collapsible for storage. For example, the collapsible training stand may comprise square tubing that is connected with a variety of linkages that allow the training stand to be locked rigidly with a vertical square tube held securely in place. The training stand can easily be unlocked and folded down to a compact set of tubes that are easy to store.

Conventional training stands are either bolted to a wall or floor for permanent installation or have bulky hollow bases that must be filled with water or sand to keep them from moving. As a result they are not easily moved or stored. By contrast, the portable training stand according to embodiments of the invention may be set up quickly and may quickly collapse for easy moving or storage.

Figure 14:
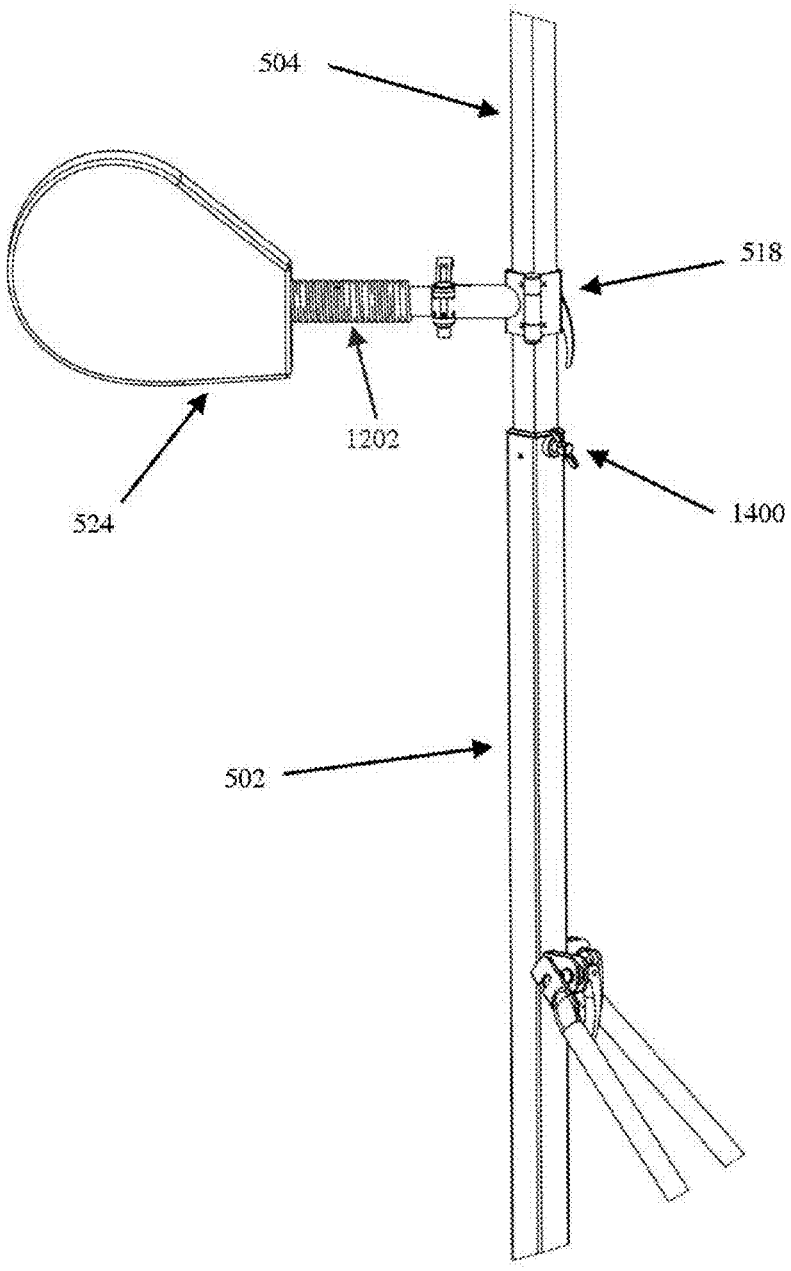
FIG. 14 illustrates a close-up view of at least one target positioned on the training stand of FIG. 9.

FIGS. 1 through 6 illustrate the training stand 100 in its upright and usable configuration from different perspectives. The training stand 100 includes a central frame member, i.e., a central support shaft 502 having one or more telescoping pieces 504 that can allow for adjusting the height of the stand. That is, the one or more telescoping pieces 504 can be extended or retracted to a desired height for exercising or mounting striking/kicking pads or targets. A locking mechanism 1400 (shown in FIG. 14), such as a pin, screw, or clamp, may serve to lock the one or more telescoping pieces 504 at a particular height. The training stand 100 may be adjustable in height by having a locking clamp 1400 that allows the telescoping pieces 504 to extend or retract from the central support shaft 502.

Additionally, a base operatively coupled to the central support shaft 502 includes folding legs 506 and 508 which may be pivotally coupled to one end of the central support shaft 502. Side linkages 512 and 514 serve to couple the central support shaft 502 and legs 506 and 508 in a fixed position. In the preferred configuration, a first end of the linkages 512 and 514 may be pivotally coupled to the legs 506 and 508 and a second end of the linkages hook onto brackets and clamp into place using a quick release clamp 516. When the side linkages 512 and 514 are locked into place on the central support shaft 502, the legs 506 and 508 are maintained substantially perpendicular to the central support shaft 502. When the side linkages 512 and 514 are unclamped from the central support shaft 502, they may be pivotally rotated around their connections with the folding legs 506 and 508 to collapse the training stand for storage. Alternatively, the side linkages 512 and 514 may be locked into place on the central support shaft 502 using pins, screws or any equivalent thereof.

In another example, the second end of the linkages 512 and 514 may be pivotally attached to a collar that slides on the central support shaft 502. The sliding collar may be locked into position on the central support shaft 502 to maintain the legs 506 and 508 substantially perpendicular to the central support shaft 502. The sliding collar may use a pin, a clamp, a screw or an equivalent mechanism to lock it into position.

Figure 8:
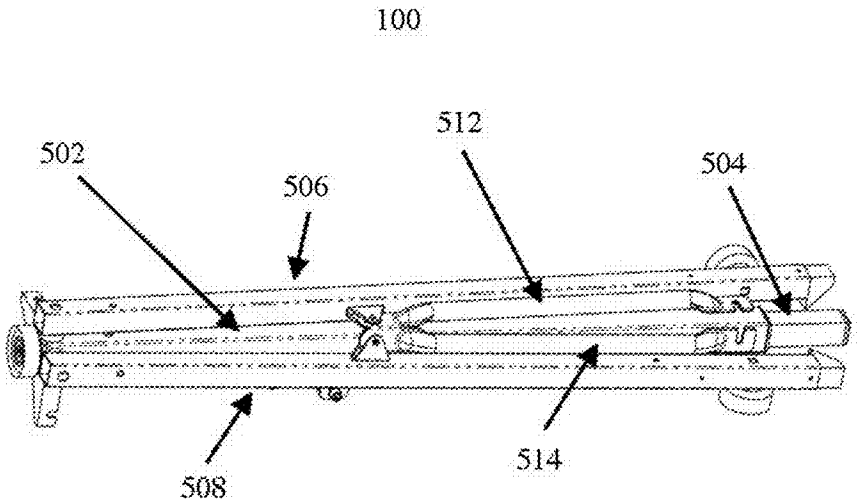
FIG. 8 illustrates a perspective view of the training stand of FIG. 1 in a collapsed state with no attachments thereon.
Figure 7:
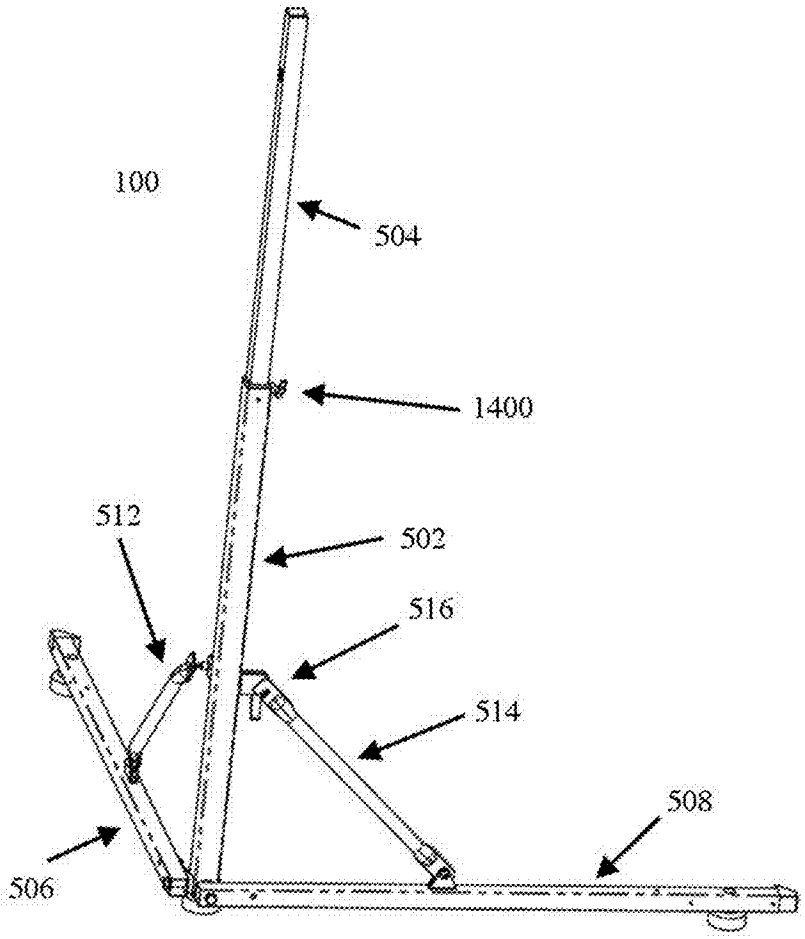
FIG. 7 illustrates a perspective view of the training stand of FIG. 1 in an expanded state with no attachments thereon.

FIG. 7 shows the training stand 100 in an upright and fully extended position with all the training pads, targets and other attachments removed. FIG. 8 shows the training stand 100 in its collapsed configuration for storage. As illustrated, the legs 506 and 508 may be folded against the central support shaft 502 while the telescoping pieces 504 may be refracted into the central support shaft 502.

The stand 100 may have square tubing or it might have some other tubing shape such as round or rectangular, for example. Additionally, the length of the folding legs 506 and 508 of the support stand 100 may be selected to provide stability to the stand 100 when it is used for punching or kicking training.

Figure 5:
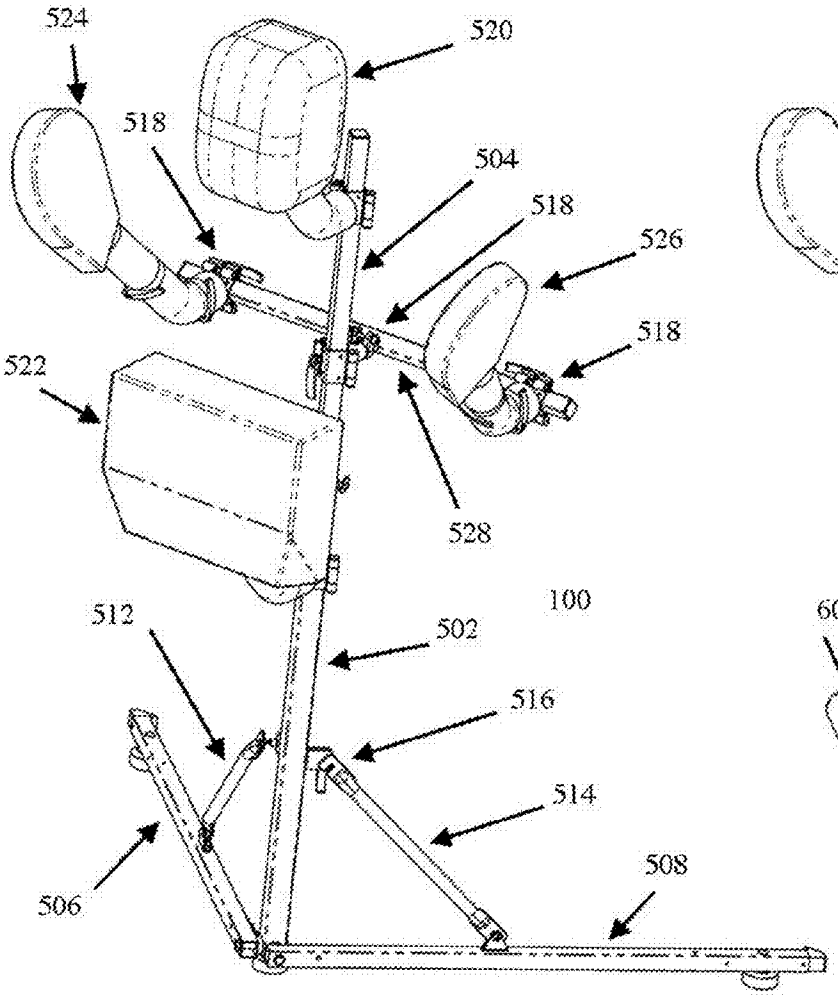
FIG. 5 illustrates a perspective view of the training stand of FIG. 1.
Figure 15:
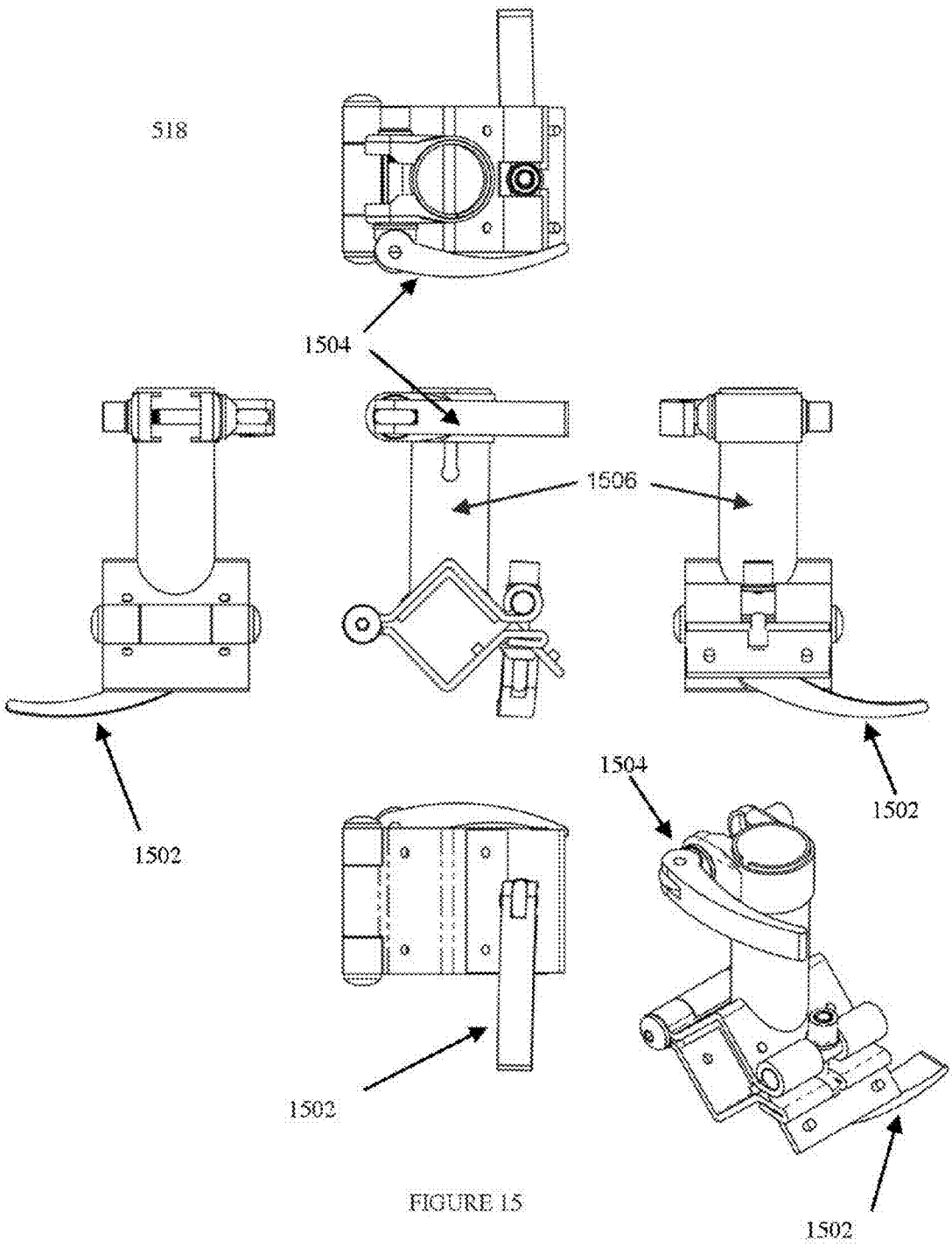
FIG. 15 illustrates various views of an embodiment of a connector which may be used in conjunction with the training stand of FIG. 1 and FIG. 9.

One advantage of this training device is that each pad, target and connector is easily removed from the stand 100 for storage through the use of quick release connectors or other easy to actuate clamping or pin mechanisms. The training stand 100 may include a plurality of connectors for attaching different training pads and targets. FIG. 5 shows a connector 518 (i.e., attachment member) on several locations on the training stand 100, i.e., on three (3) different locations on a T-Bar support 528. An example of a connector 518 that may be used is shown in FIG. 15. In one embodiment, T-Bar support 528 may be rotatable three hundred and sixty (360) degrees about the tube 1506 in the connector 518.

Figure 16:
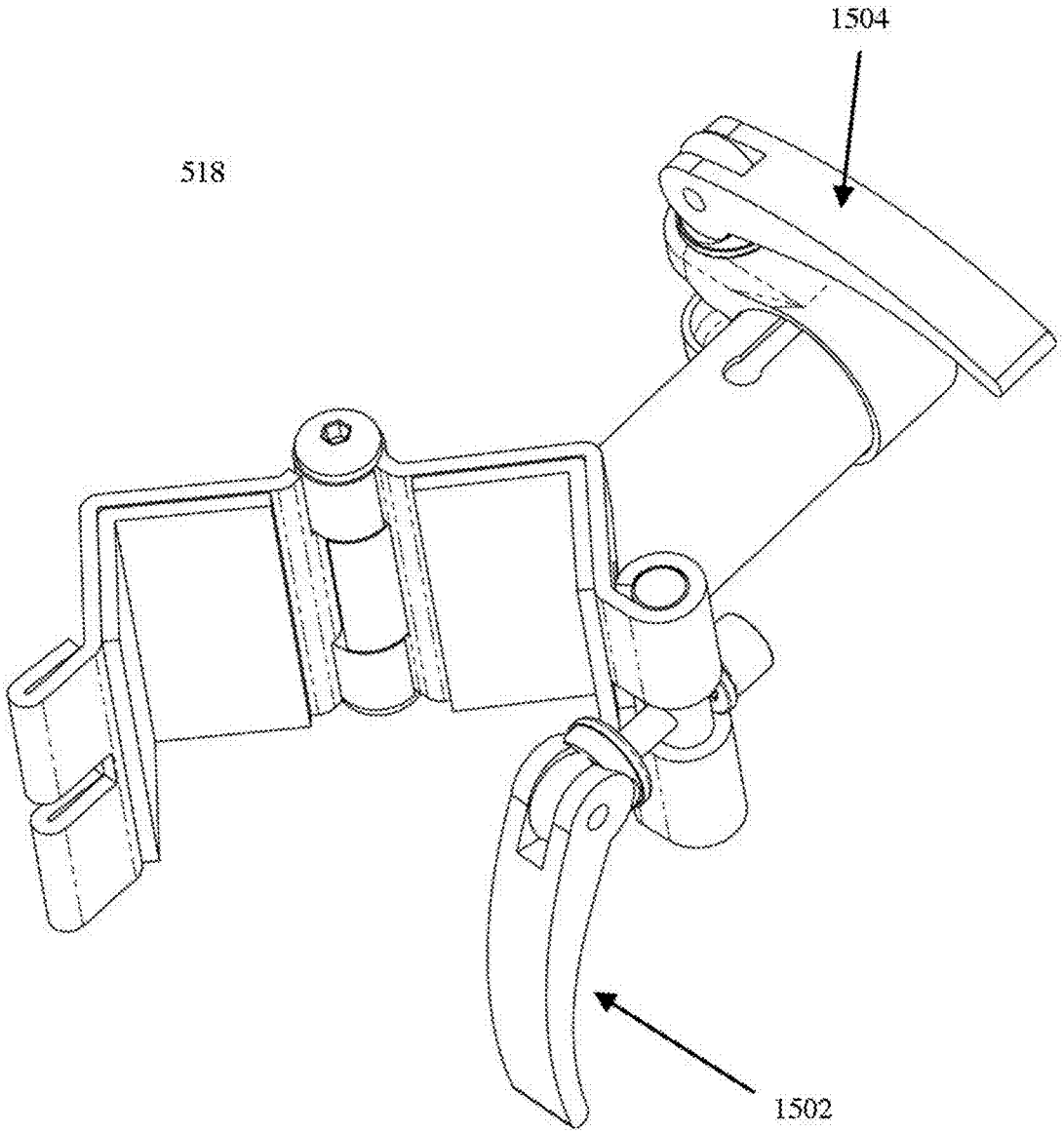
FIG. 16 illustrates a close-up view of the connector of FIG. 15.

FIG. 15 shows several views of the connector 518 in its closed configuration. FIG. 16 shows the connector 518 in its open configuration. Each of the connectors 518 may be attached anywhere along the length of the central support shaft 502 and telescoping piece 504 and locked rigidly thereto. Additionally, each of the connectors 518 may be attached anywhere along the length of the T-Bar support 528. The use of quick release clamps 1502 to attach the connectors 518 to the stand allow for easy attachment, easy removal and easy adjustability along the central support shaft 502 and the telescoping piece 504. The use of quick release clamps 1504 also allow for easy attachment, easy removal and easy adjustability of different training pads and targets without removing the connector from the central support shaft 502 or the telescoping piece 504.

Figure 6:
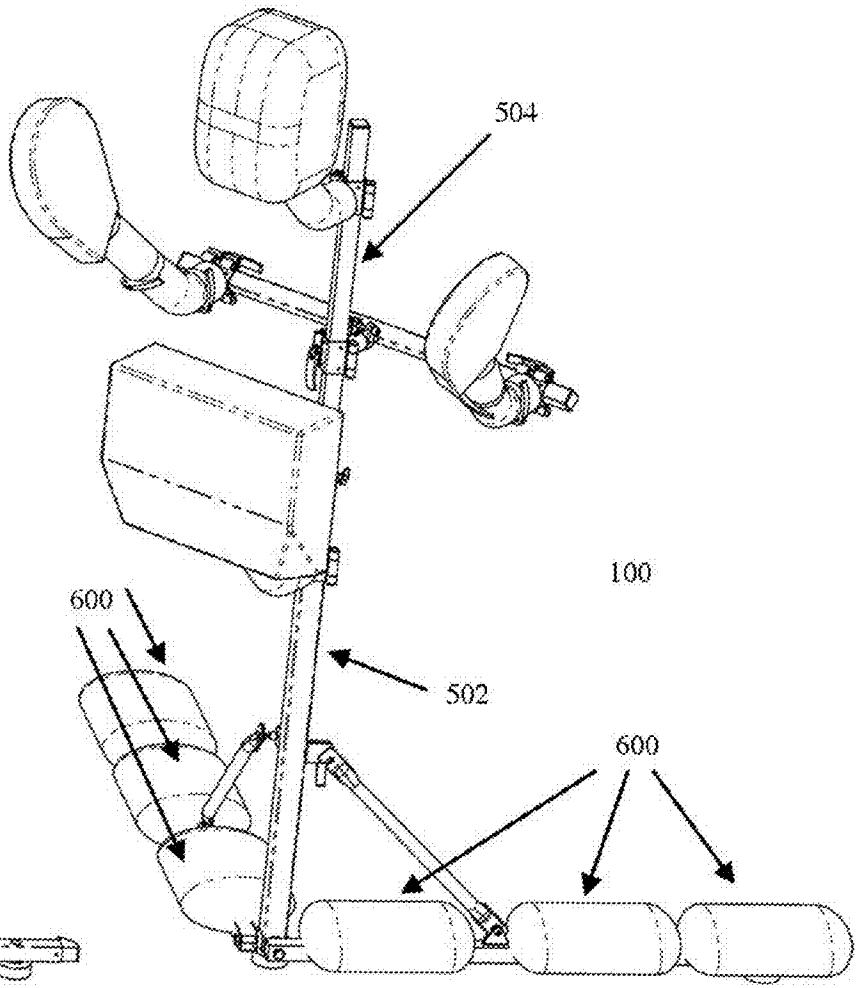
FIG. 6 illustrates a perspective view of the training stand of FIG. 1 with weight bags thereon.
Figure 18:
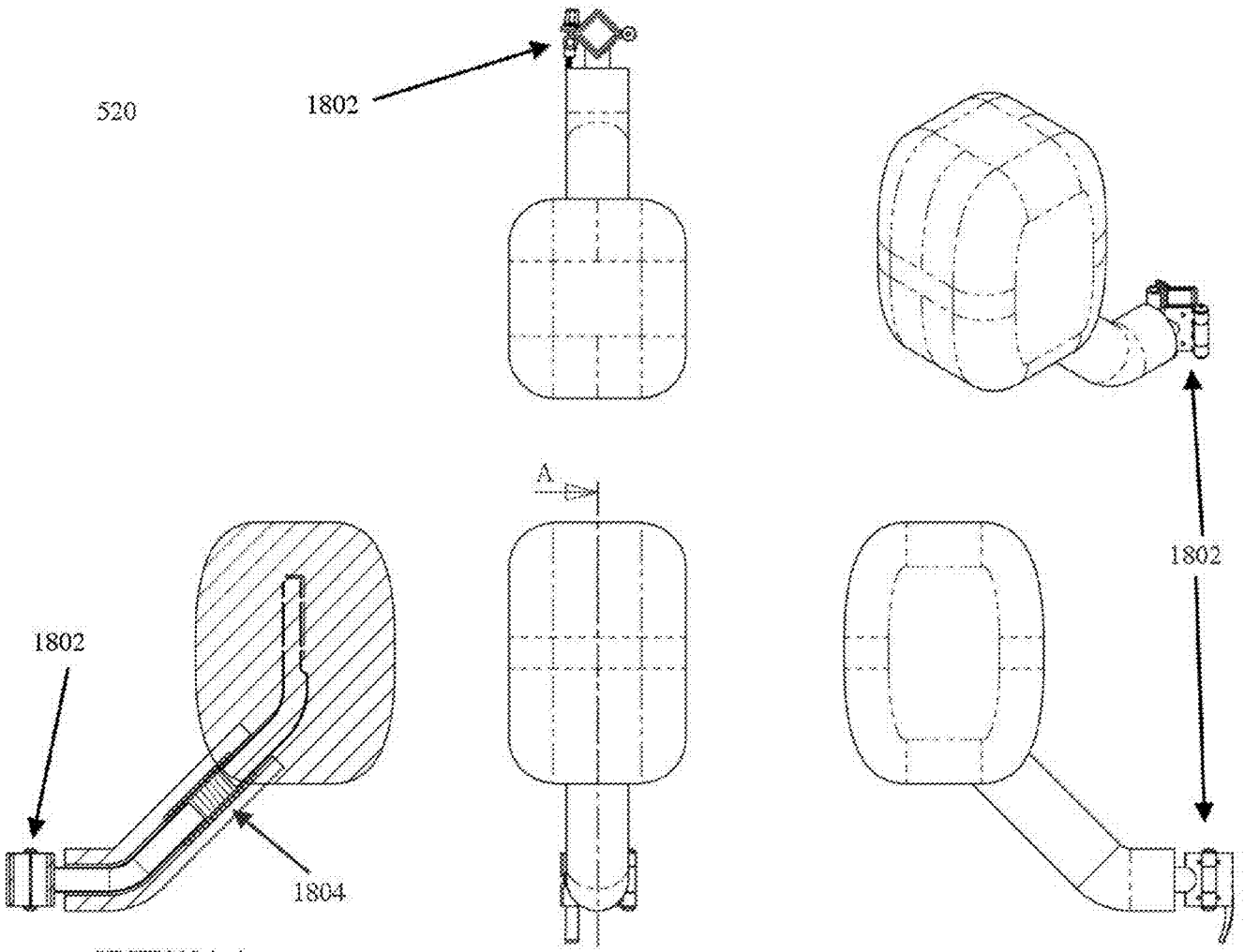
FIG. 18 illustrates various views of an embodiment of a head target which may be positioned on the training stand of FIG. 1 or FIG. 9.
Figure 19:
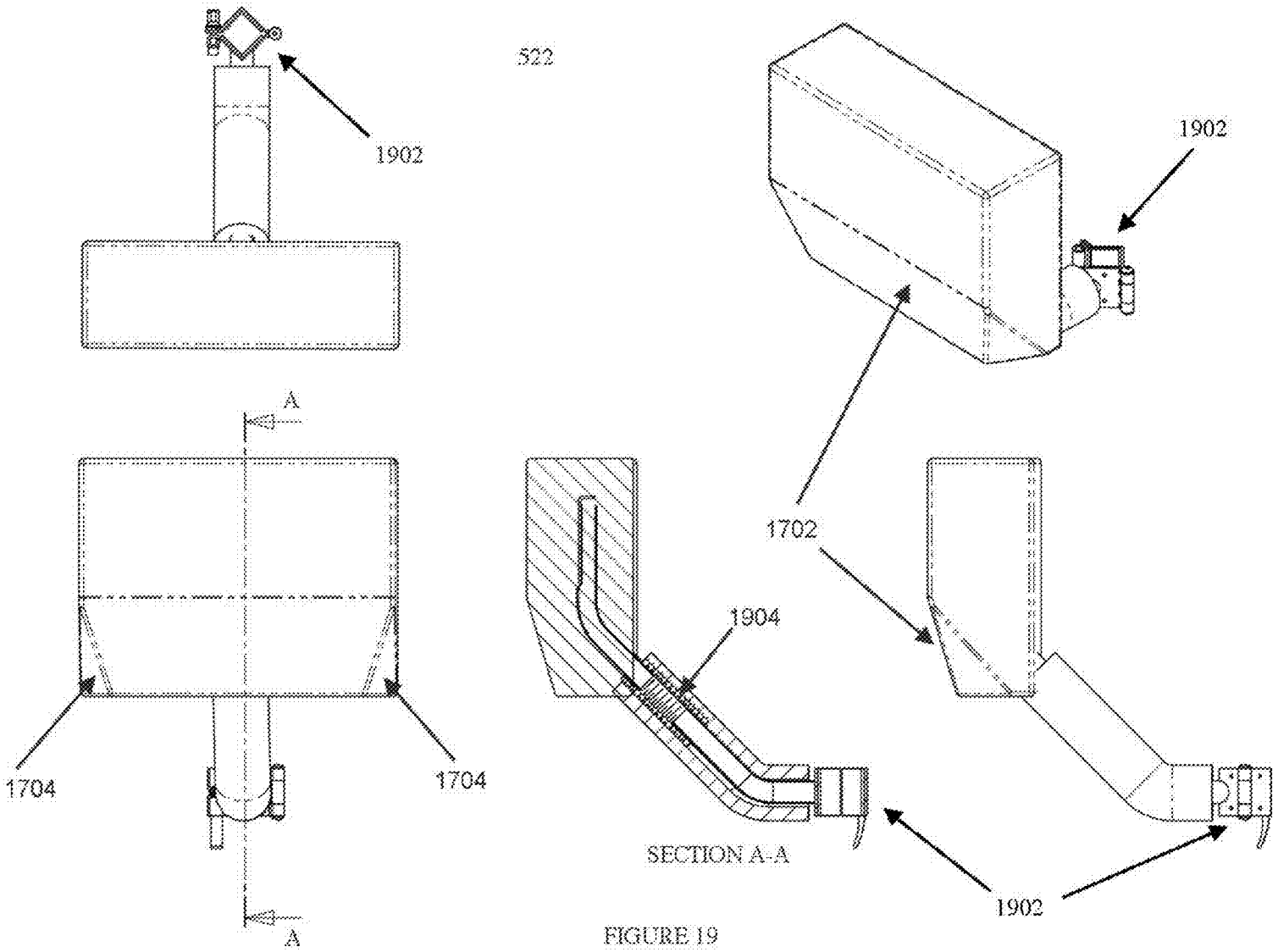
FIG. 19 illustrates various views of an embodiment of a torso target which may be positioned on the training stand of FIG. 1 or FIG. 9.

The connector 518 may be removable from the pad as shown in the configuration in FIGS. 15, 16 and 20. Alternatively, the connector 518 may be permanently attached to one of the pads as shown in FIG. 18 item 1802 and in FIG. 19 item 1902. One advantage of attaching some pads permanently to a connector is to hold the pads securely in a preferred orientation. For example, head and torso pads may be held in the vertical orientation so they are permanently attached to the connectors. In some embodiments, the connectors allow for rotational movement about the training stand FIGS. 5 and 6 illustrate how different objects, i.e., striking pads or targets may be coupled to the training stand 100. A first target 520 may be in the form of a human head while a second target 522 may be in the form of a human torso. The shapes of first and second targets 520, 522 are shaped to allow upper cut punching thereto. Moreover, second target 522 may include angled corners, 1702 and 1704 i.e., at the bottom corners, to guide the user to use correct form. The optional T-Bar support 528 is shown attached to the telescoping piece 504 in a substantially horizontal orientation. Additional targets 524 and 526 mimic an attacker's arm and hand and are shown attached to the T-Bar support 528. Each pad or target 520 and 522 may be adjusted up or down along the length of the central support shaft 502 and telescoping piece 504. Each pad or target may be coupled to the central support shaft 502 and telescoping piece 504 using connectors 518, 1802 or 1902. Each pad or target 524 and 526 may be adjusted anywhere along the length of the T-Bar support 528 using connectors 518. Although the T-Bar support 528 is shown in a substantially horizontal orientation, the T-Bar support 528 may be adjusted in any vertical position or a 360 degrees orientation relative to the tube 1506 in the connector 518. This helps accommodate users of different heights as well as to simulate a person of different heights for whom the user wishes to defend himself or herself against.

Figure 1:
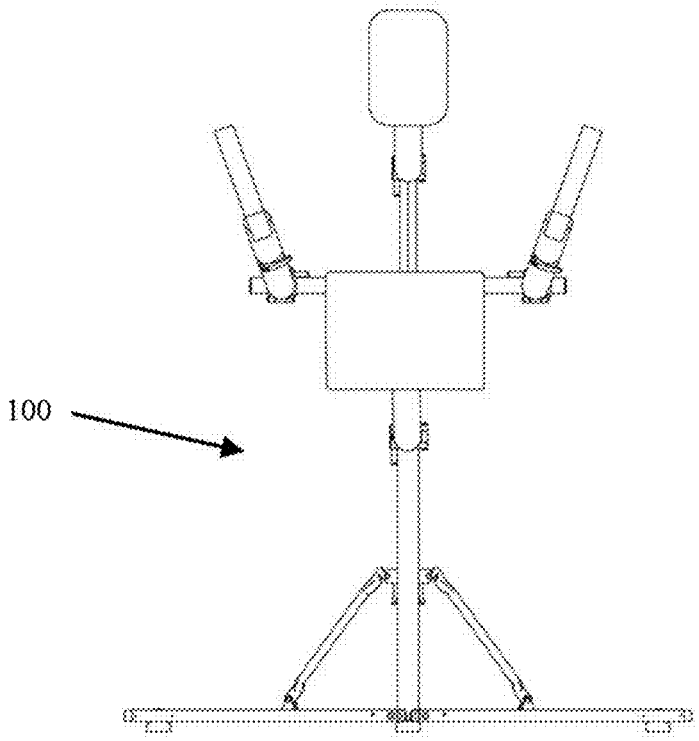
FIG. 1 illustrates a front view of a training stand according to an embodiment of the invention.
Figure 2:
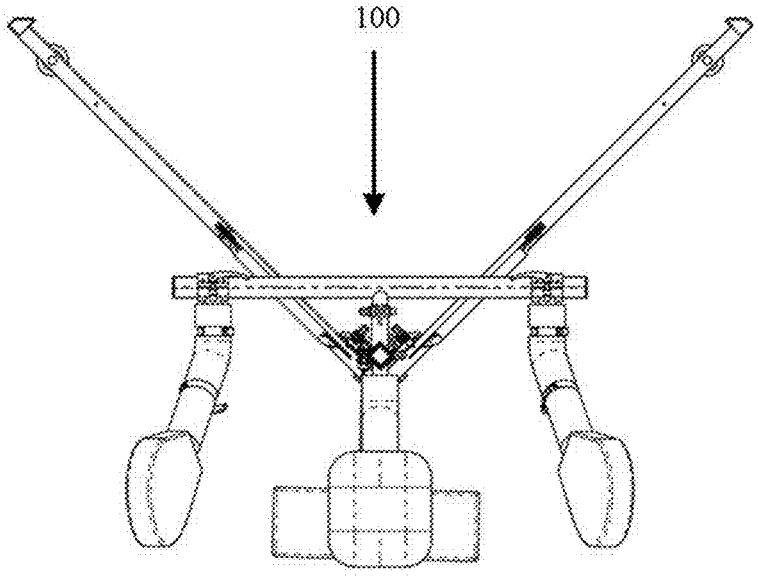
FIG. 2 illustrates a top view of the training stand of FIG. 1.
Figure 4:
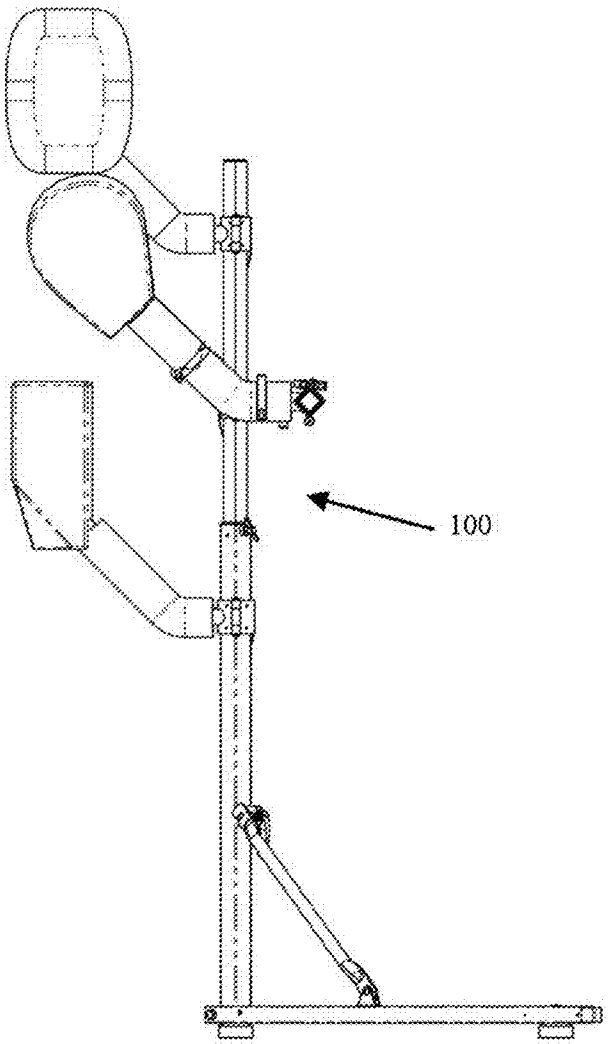
FIG. 4 illustrates a left side view of the training stand of FIG. 1.
Figure 3:
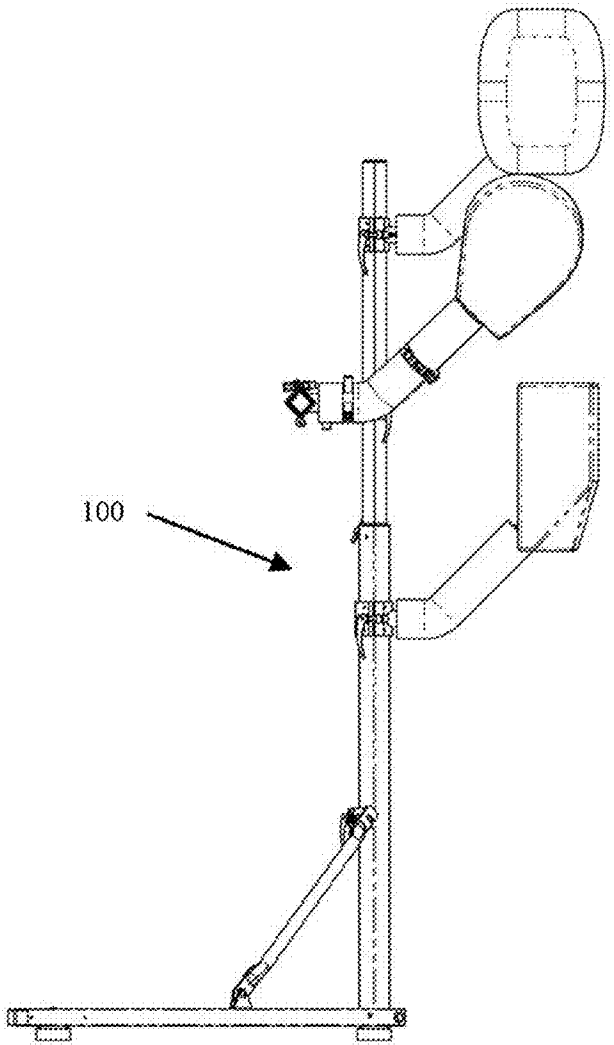
FIG. 3 illustrates a right side view of the training stand of FIG. 1.
Figure 21:
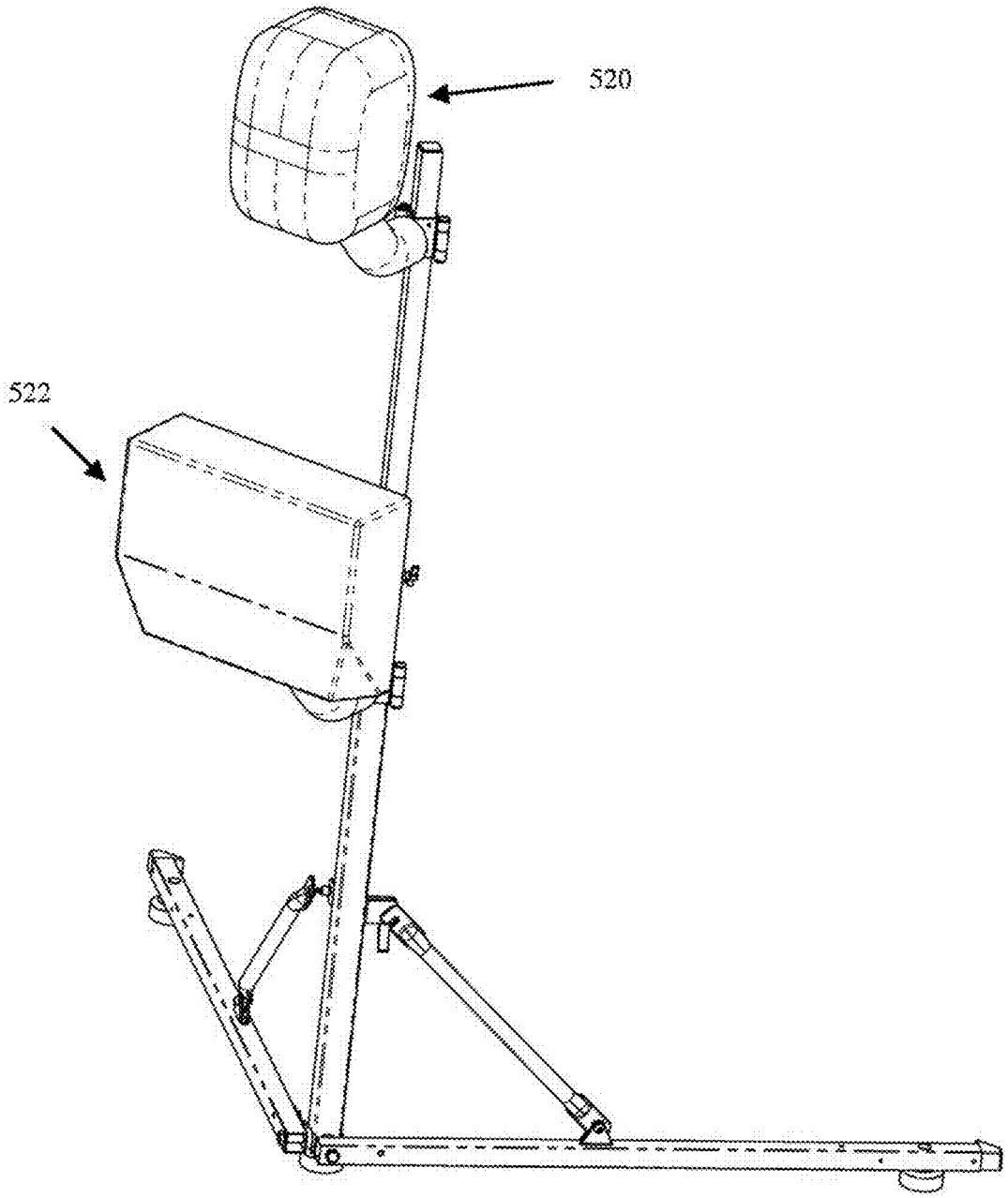
FIG. 21 illustrates a perspective view of another configuration the training stand of FIG. 1.

FIG. 21 illustrates a perspective view of another configuration the training stand of FIGS. 1 and 5. In this configuration the training stand includes just the first target 520 (head pad) and second target 522 (torso pad) while the remaining targets have been removed.

Figure 22:
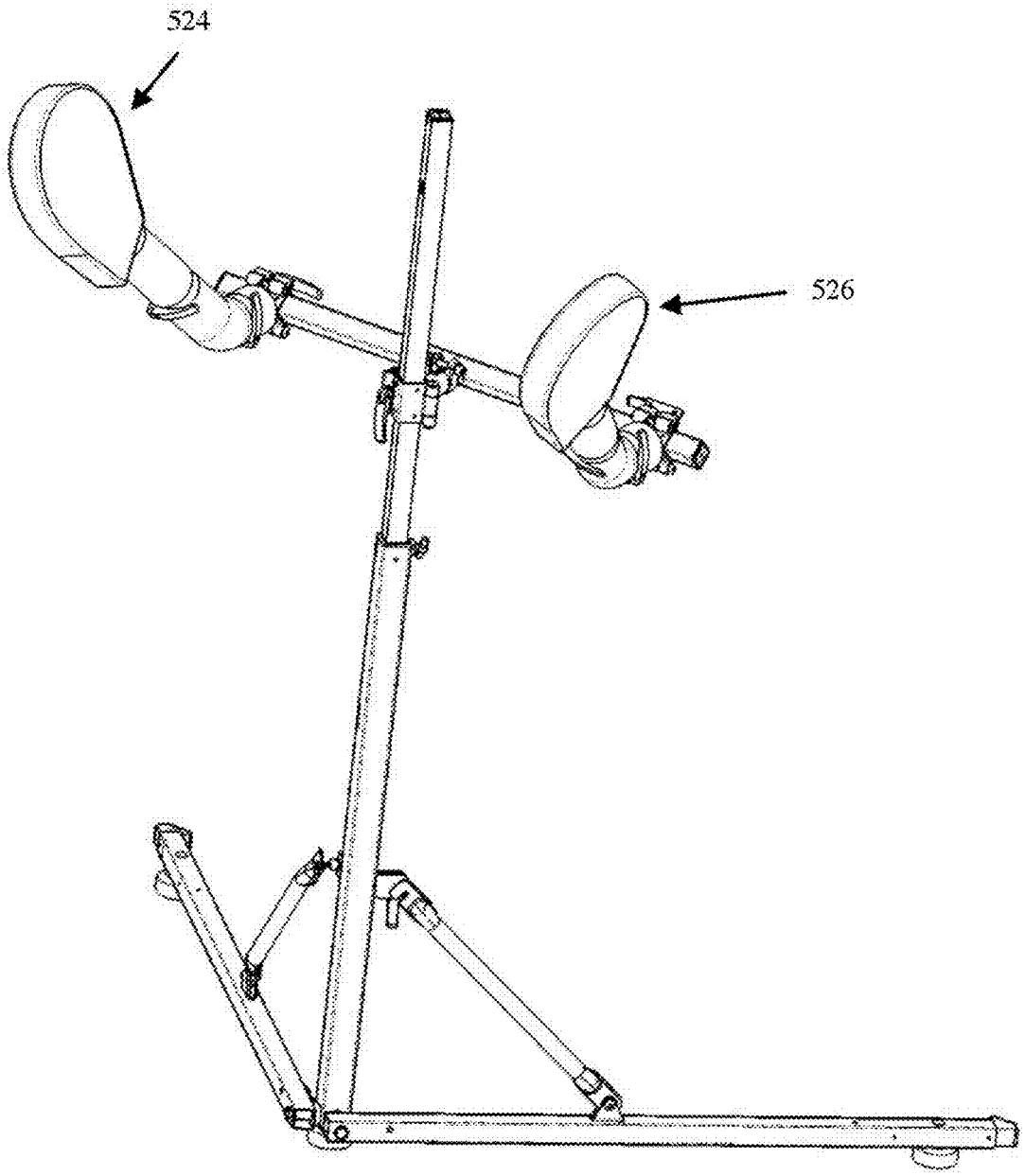
FIG. 22 illustrates a perspective view of yet another configuration the training stand of FIG. 1.
Figure 23:
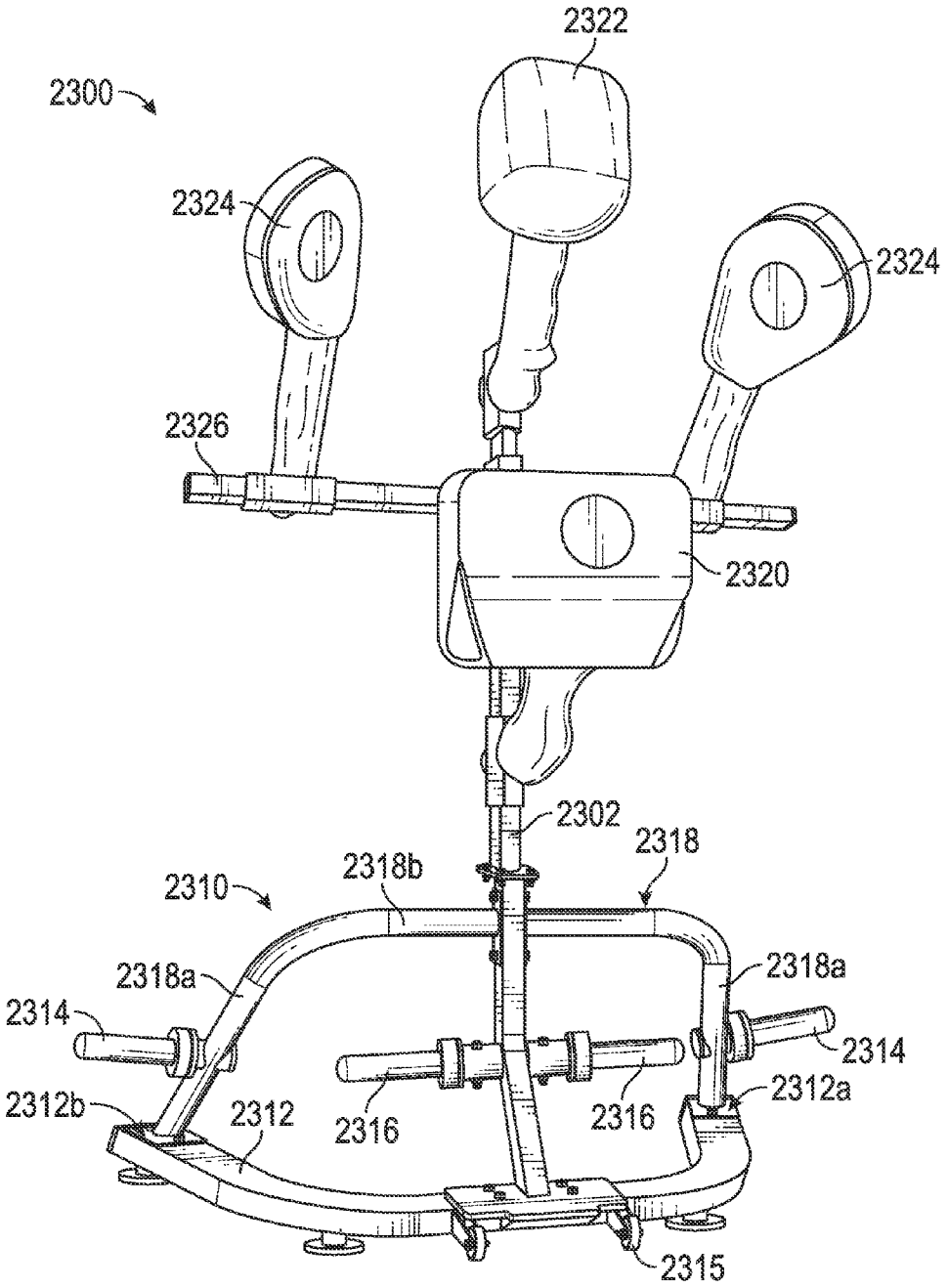
FIG. 23 illustrates a front perspective view of a training stand according to an embodiment of the invention.
Figure 24:
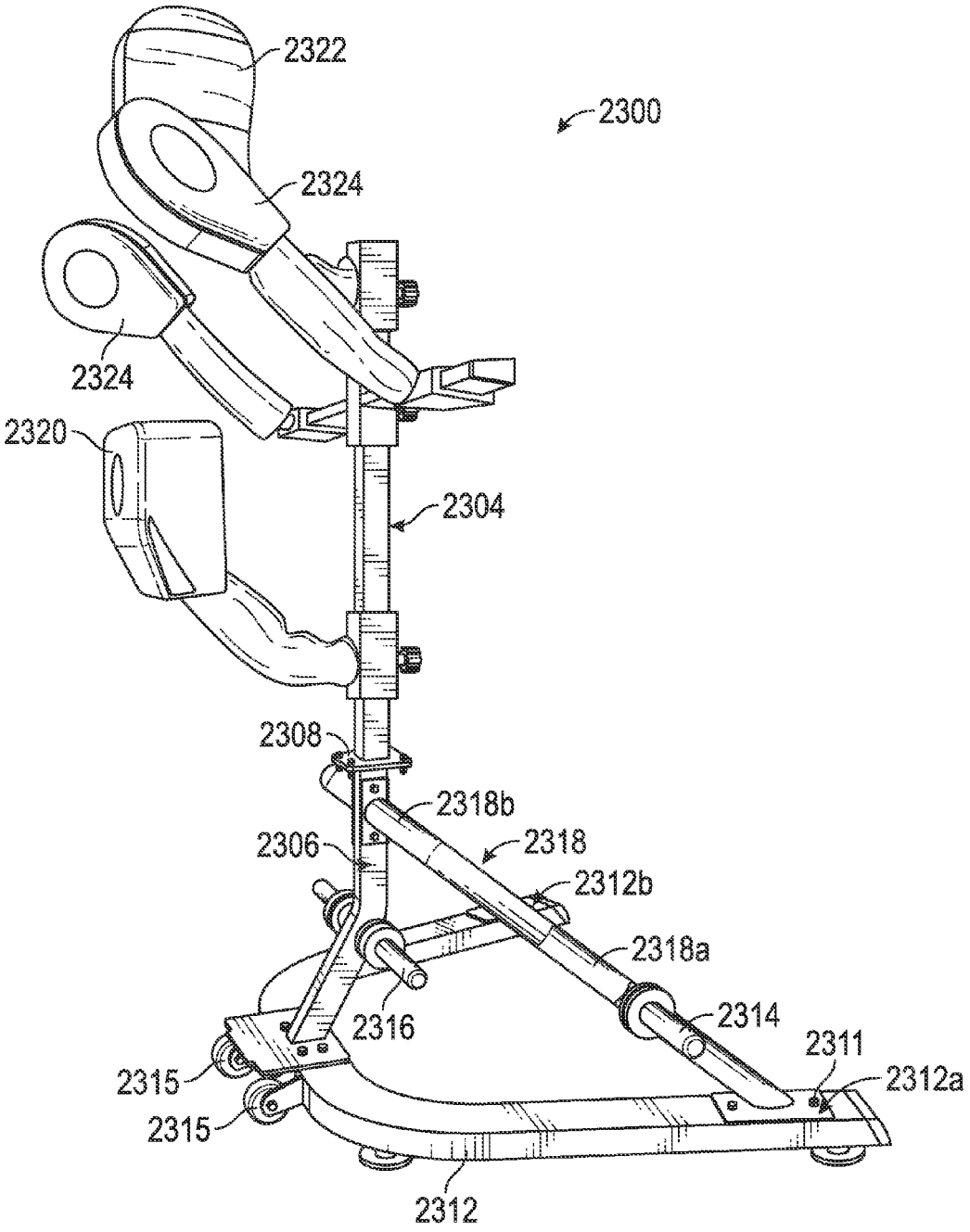
FIG. 24 illustrates a side perspective view of the training stand of FIG. 23.

FIG. 22 illustrates a perspective view of yet another configuration the training stand of FIGS. 1 and 5. In this configuration the training stand includes just the pads 524 and 526 attached to the T-bar support while the remaining targets have been removed.

Figure 17:
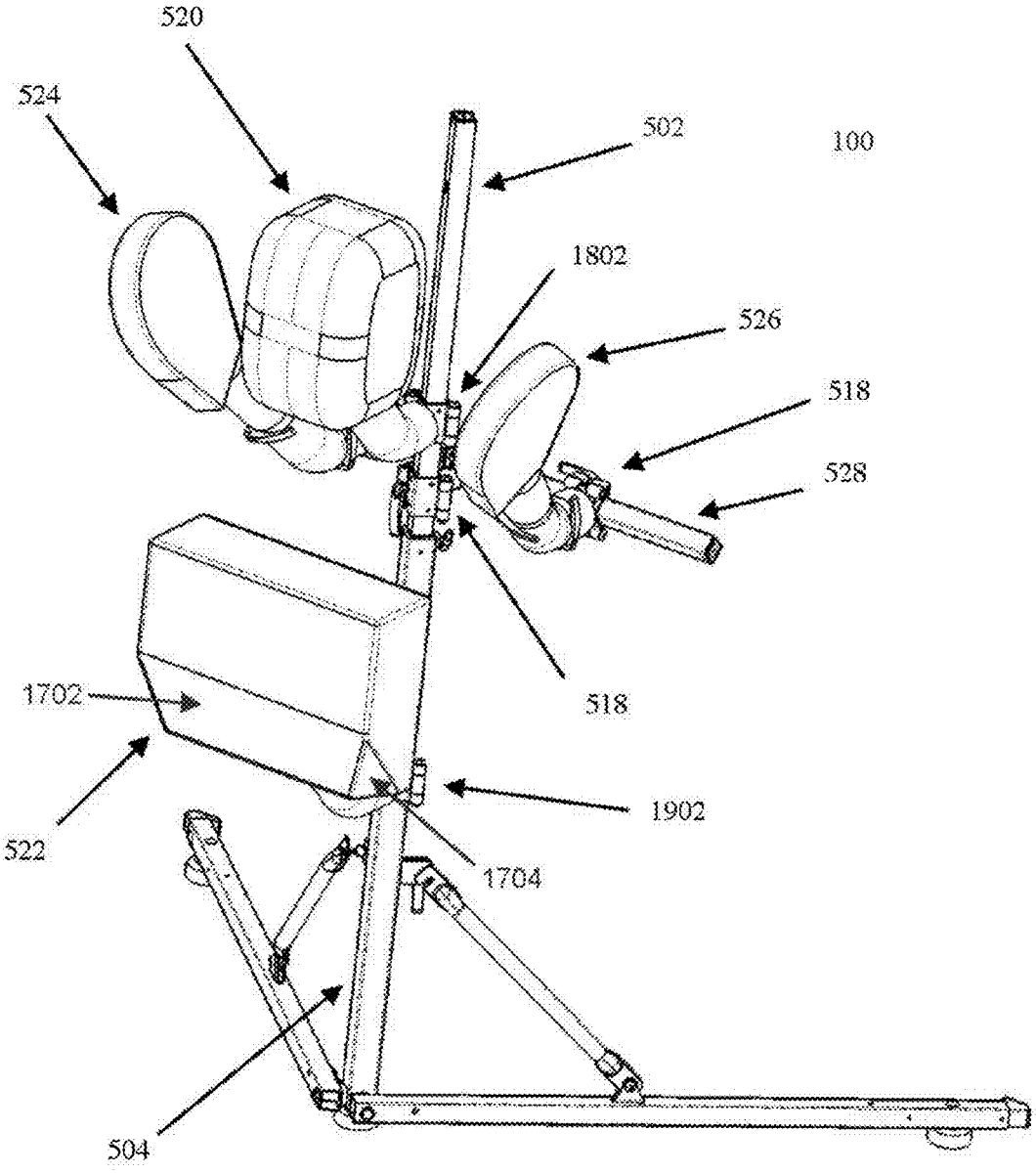
FIG. 17 illustrates a perspective view of the training stand of FIG. 1.

FIG. 17 illustrates how the same training pads and targets shown in FIG. 5 can be adjusted to simulate a smaller sized opponent. The human head shape target 520 and the human torso shape target 522 have been moved downward significantly along the central support shaft 502 and telescoping piece 504. The arm shaped targets 524 and 526 have moved significantly inward toward the central support shaft 502.

FIGS. 9, 10, 11, 12 and 13 illustrate the targets 524 and 526 in different positions attached to the training stand 100. The targets may be rotated into different orientations by adjusting the connectors 518 for practicing punching or kicking from any direction up, down, side to side or any angle in between. Between the connectors 518 and strike pads, the targets 520, 522, 524 and 526 may include a spring 1202, 1804 and 1904 such as a coil spring, or some other flexible material and/or component that can absorb or break the impact when the pads are struck.

Figure 11:
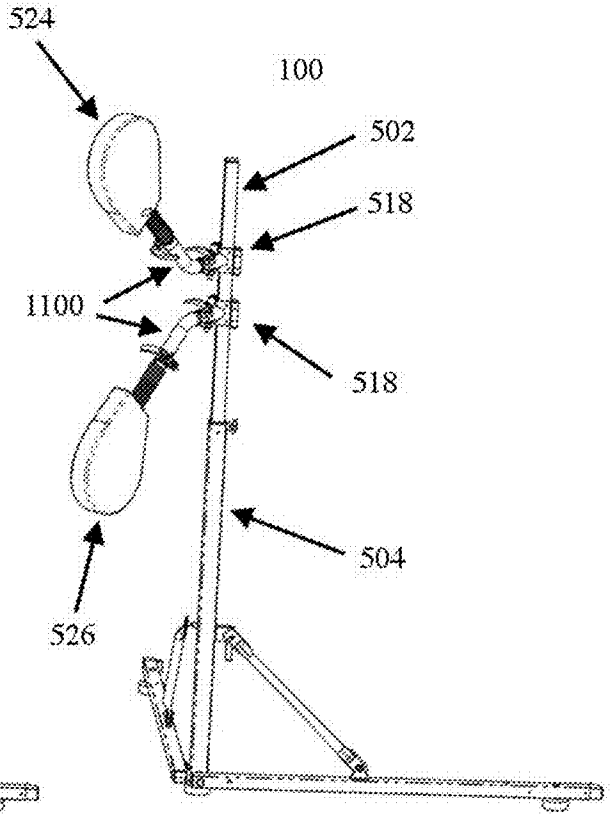
FIG. 11 illustrates the training stand of FIG. 9 with at least two targets positioned in yet another alternative position thereon.
Figure 10:
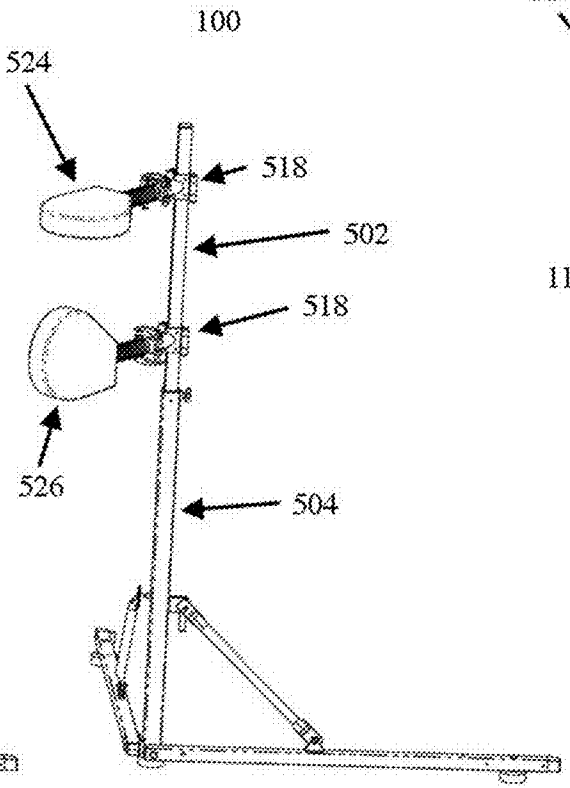
FIG. 10 illustrates the training stand of FIG. 9 with at least two targets positioned in an alternative position thereon.
Figure 9:
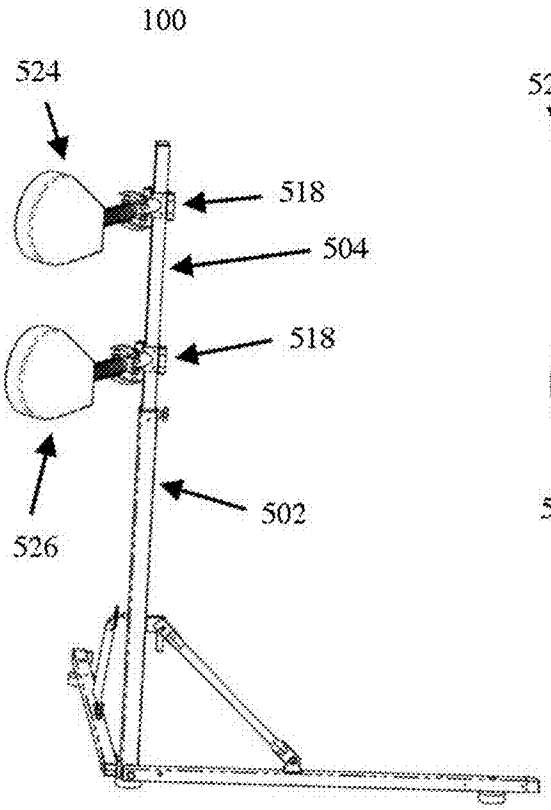
FIG. 9 illustrates a training standing according to another embodiment of the invention with at least two targets positioned thereon.
Figure 13:
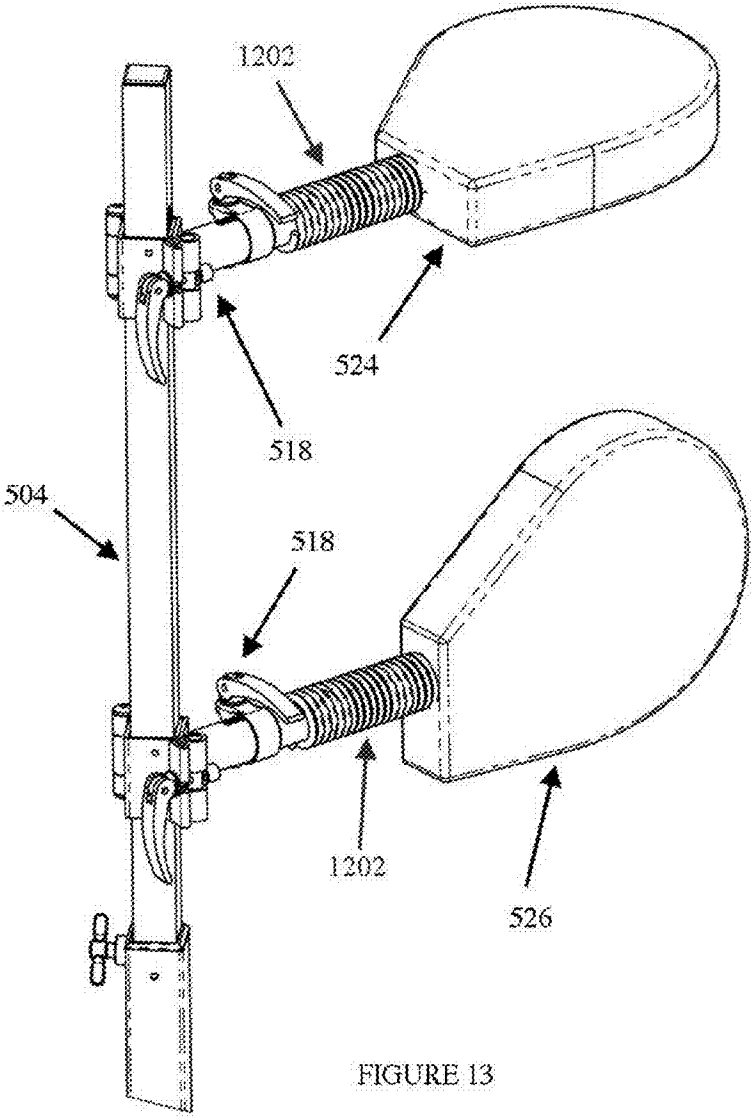
FIG. 13 illustrates a close-up view of at least two targets alternatively positioned on the training stand of FIG. 9.
Figure 12:
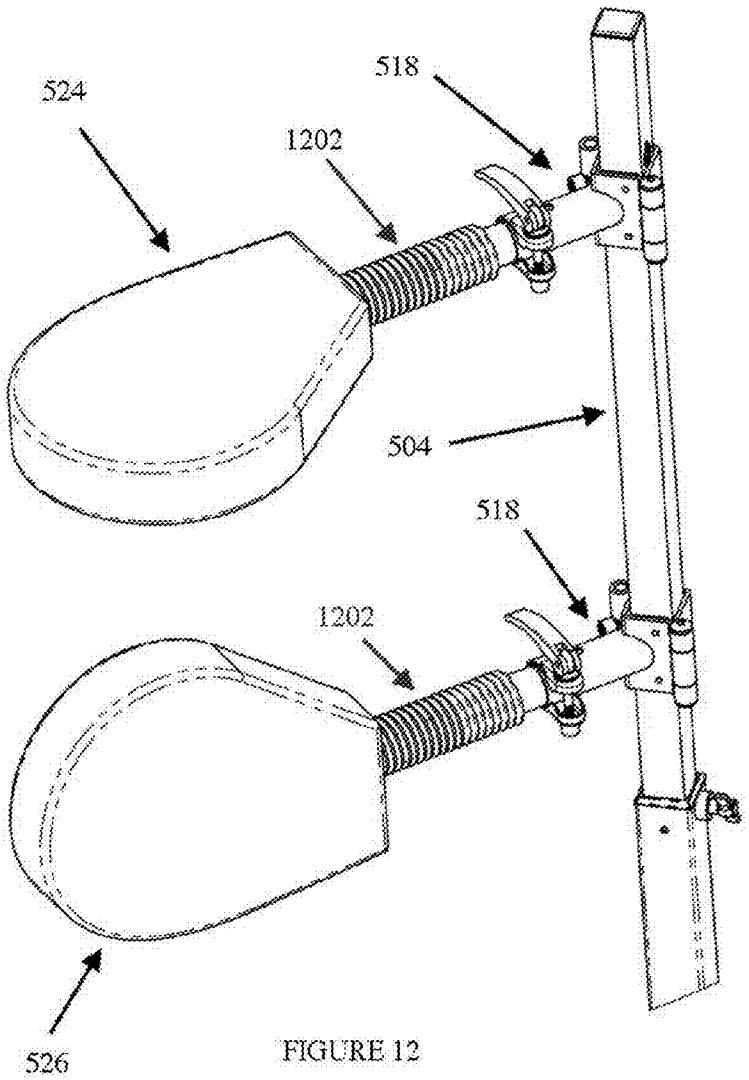
FIG. 12 illustrates a close-up view at least two targets positioned on the training stand of FIG. 9.

FIG. 11 illustrates optional extension attachments 1100 with angles which allow the targets 524 and 526 to have an additional degree of freedom of adjustability in their orientation. In one embodiment, the extension attachment 1100 is angled at less than 90 degrees. In another embodiment, the extension attachment 1100 is angled at about 135 degrees, although other embodiments may allow the angle of the extension attachment 1100 to be adjustable to other angles. The extension attachment 1100 may include a spring, such as a coil spring or some other flexible material that can absorb or break the impact when the targets are struck.

In some embodiments, there may be additional targets which attach to the training stand 100 using the same or different types of connectors. In other embodiments, there may be pads or targets in the shape of an arm, leg, hand or foot that attach to the training stand. Each of these may be adjusted along any position of the training stand.

In some embodiments, a fake gun or knife may be attached to the training stand 100, for example, to further practice self-defense techniques.

There may be additional type of targets that attach to the training stand that move on their own and actually simulate attacking the person who is training with the stand. This may be accomplished using electric motors or spring-loaded devices that release automatically or manually when the person training decides to release the moving attack targets. This movement may be regular or random.

FIG. 6 shows one implementation where weight bags (e.g., sand bags) 600 may be placed over the folding legs 506 and 508 to help keep the stand 100 in place when the pads or targets are struck. The use of small weight bags 600 allow for easily moving the training stand to a different location or putting it away for storage.

In alternative implementations, the training stand 100 may be kept in place by using weights that are normally used for weight lifting exercises.

In alternative implementations, the training stand can be permanently mounted to the ground using bolts or some other method, and the training stand still maintains the advantage of adjustability for users of many different sizes and training that simulates attackers of many different sizes.

In some implementations, parts of the support stand, e.g., central support shaft 502 and telescoping piece 504, may have additional padding to protect a user from accidentally hitting the stand 100.

FIGS. 23 through 29 illustrate a training stand 2300 in its upright and usable configuration from different perspectives, according to one embodiment. The training stand 2300 may be formed to at least partially receive a second training stand and may have square tubing or it might have some other tubing shape such as round or rectangular, for example.

The training stand 2300 may include a central frame member, i.e., a central support shaft 2302 comprising an upper portion 2304 and a lower portion 2306 joined at a coupling point 2308. A base 2310 may be operatively coupled to the central support shaft 2302 and may include a U-shaped or V-shaped base member 2312 and a support member 2318 connected to and extend upwardly from a first end portion 2312*a* and a second end portion 2312*b* of the U-shaped or V-shaped bottom base member 2312, at an angle of approximately 45 degrees or less, to the central frame member. The support member 2318 may be integrally connected to, or releasably secured to, the U-shaped or V-shaped bottom base member 2312 by securing members 2311, including but not limited to bolts or screws. According to one embodiment, the support member 2318 may have the same or similar shape as the base member 2312. The support member 2318 may be formed from a single piece of tubing or alternatively, the support member 2318 may be formed by a pair of side supports 2318*a* connected to a top support member 2318*b*.

The support member 2318 may serve to couple the central support shaft 2302 and the U-shaped or V-shaped base member 2312 in a fixed position. According to one embodiment, one or more wheels 2315 may be fixedly secured to a front portion of the U-shaped or V-shaped bottom base member 2312 to permit tilting and rolling (i.e. portability) of the training stand 2300.

The central frame member and base 2310 of the training stand 2300 may be formed to at least partially receive the central frame member and base of a second training stand allowing for the nestability of a plurality of the training stands. This nestability reduces the storage space necessary for multiple training stands.

One or more upper weight support pins 2314 and/or one or more lower weight support pins 2316 may be provided onto which weights (not shown, See FIG. 30) may be added to provide stability to the training stand 2300. The one or more upper weight support pins 2314 may be fixed or removably secured to and extend outwardly from side portions of the support member 2318. In one embodiment, the one or more upper weight support pins 2314 may extend outwardly at a slightly upward angle (e.g. in a horizontal plane) to maintain the weights on the support pins 2314. The one or more lower weight support pins 2316 may be fixed or removably secured to and extend outwardly from the lower portion 2306 of the central support shaft 2302. In one embodiment, the one or more lower support pins 2316 may extend outwardly at a slightly upward angle (e.g. in a horizontal plane) to maintain the weights on the support pins 2316. In some implementations, just the one or more upper weight support pins 2314 and weights may be utilized. In other implementations, just the one or more lower weight support pins 2316 and weights may be utilized.

Figure 25:
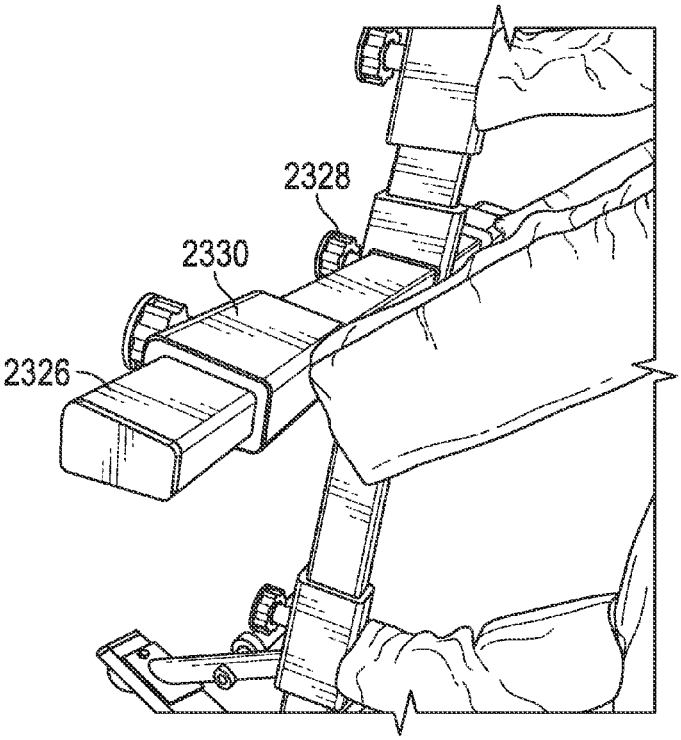
FIG. 25 illustrates a close up view of the horizontal support shaft, having a trapezoidal cross-section for preventing fasteners for the focus pads from rotating, of the training stand of FIG. 23.
Figure 26:
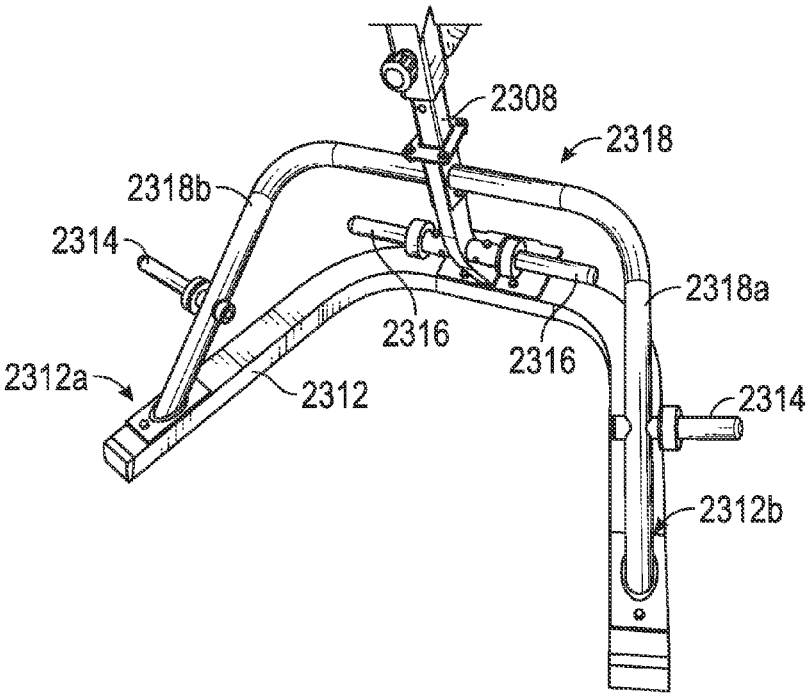
FIG. 26 illustrates a top perspective view of the base of the training stand of FIG. 23.
Figure 27:
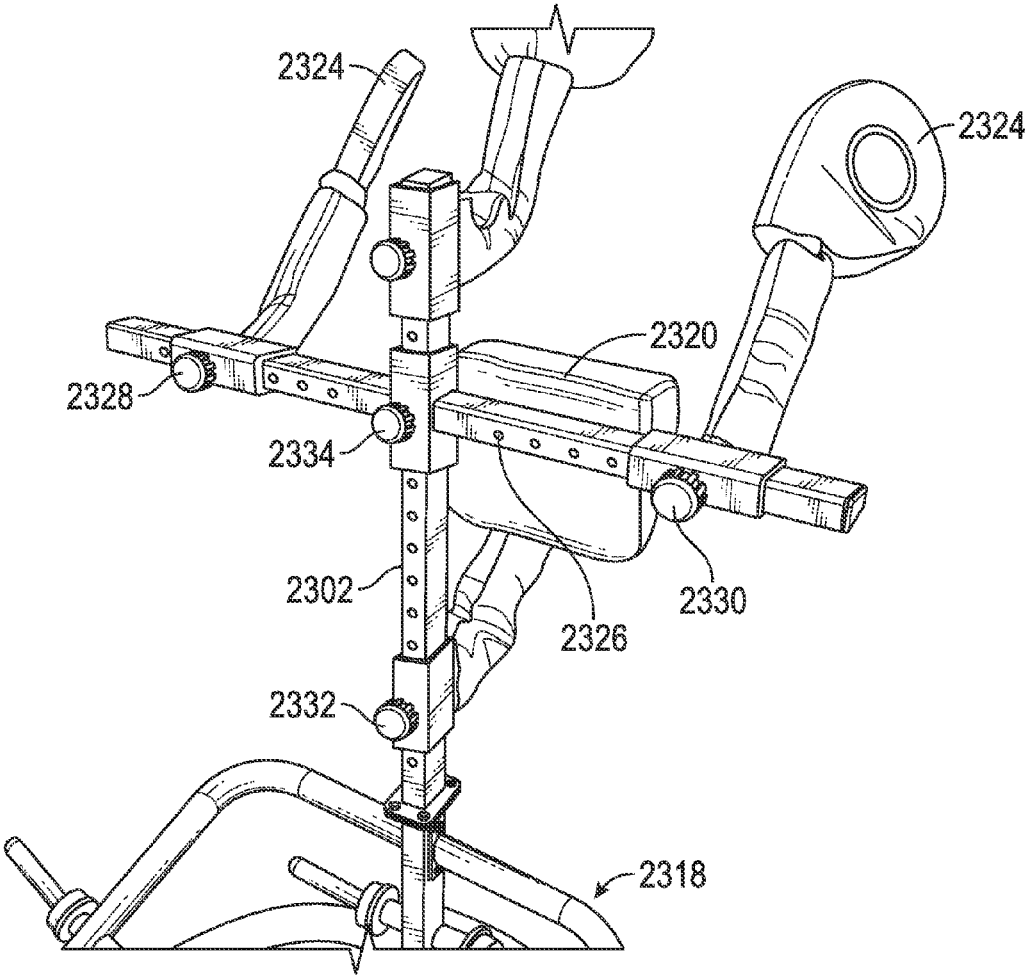
FIG. 27 illustrates a close up view of the horizontal support shaft and the central support shaft of the training stand of FIG. 23.

The training stand 2300 may also include a plurality of strike pads coupled along the central support shaft 2302. For instance, a torso pad 2320, a head pad 2322, and two focus pads 2344 may be adjustable coupled to the central support shaft 2304 so that the height of these pads (e.g., relative to the ground and to each other) may be adjusted according to the user. Additionally, a horizontal support shaft 2326 may be coupled to the central support shaft 2302 and the focus pads 2344 may be coupled to the horizontal support shaft 2326. The focus pads 2324 may be slidably adjustable. The pads 2320, 2322, and/or 2324 may include fasteners (or couplers) 2328, 2330, 2332, 2334 (See FIGS. 25 and 27) that engage preset openings/holes along the horizontal support shaft 2326 and/or central support shaft 2302. As shown in FIG. 25, the horizontal support shaft 2326 may have a trapezoidal cross-section which prevents the fasteners 2328 and 2330 for the focus pads 2324 (See FIG. 27) from rotating.

Figure 28:
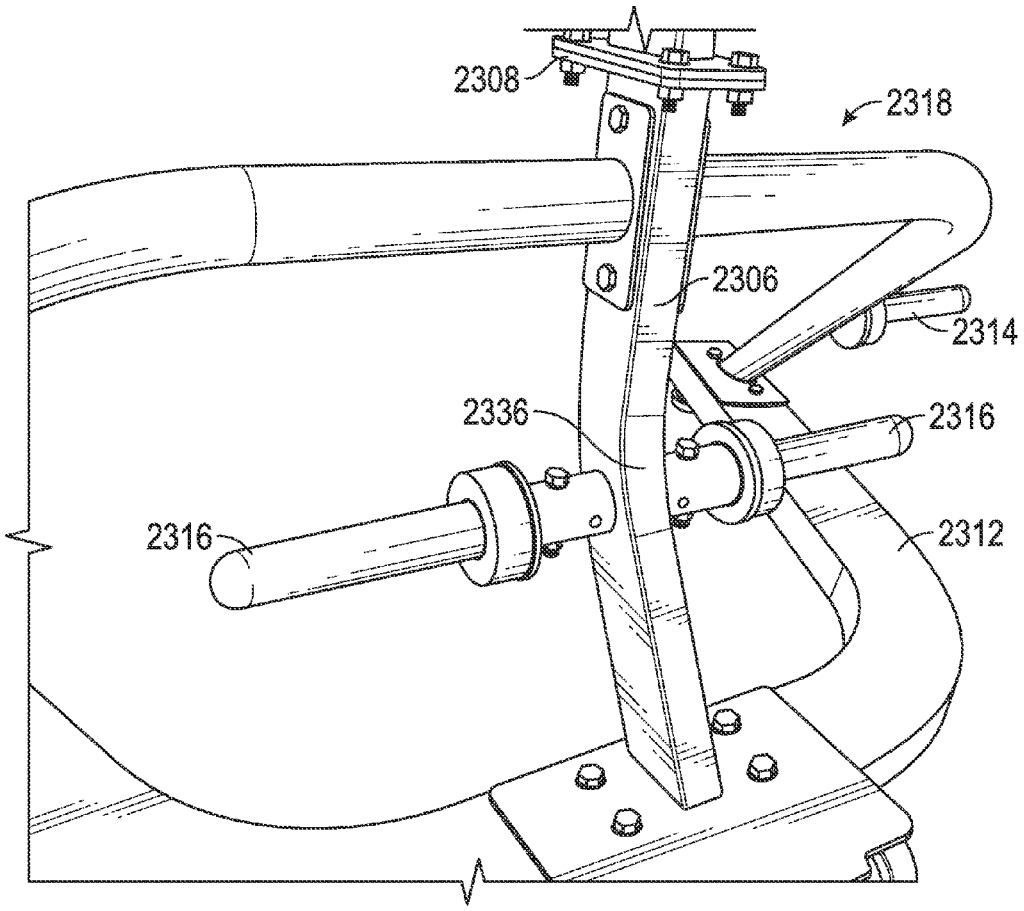
FIG. 28 illustrates a close up view of a bend along the lower portion of the central support shaft of the training stand of FIG. 23.
Figure 29:
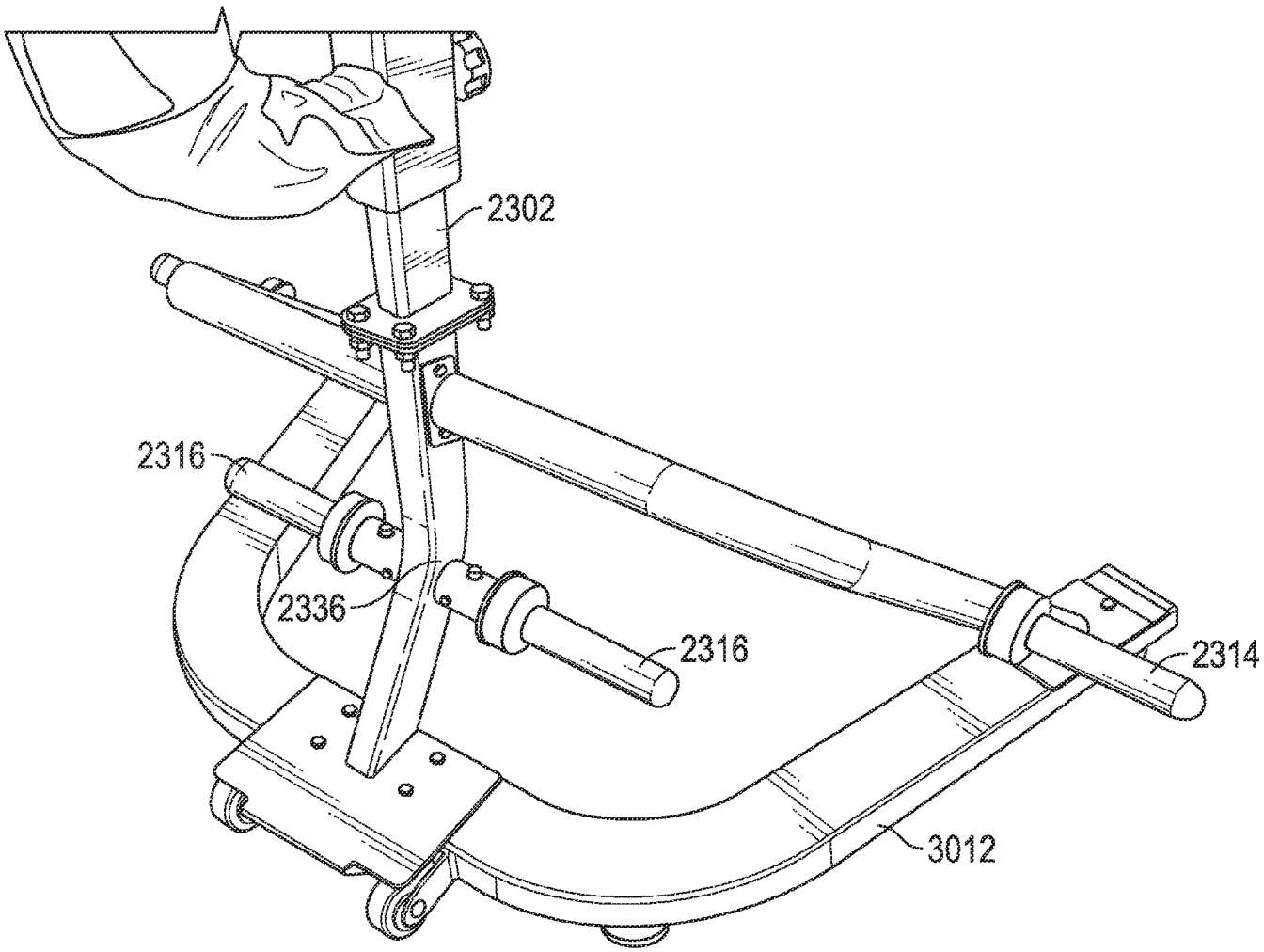
FIG. 29 illustrates a side perspective view of the base of the training stand of FIG. 23.

As shown in FIG. 28, the lower portion 2306 of the central support shaft 2302 may include a bend 2336. This bend 2336 may serves to shift the center of gravity back, thereby providing greater stability to the training stand 2300.

Figure 30:
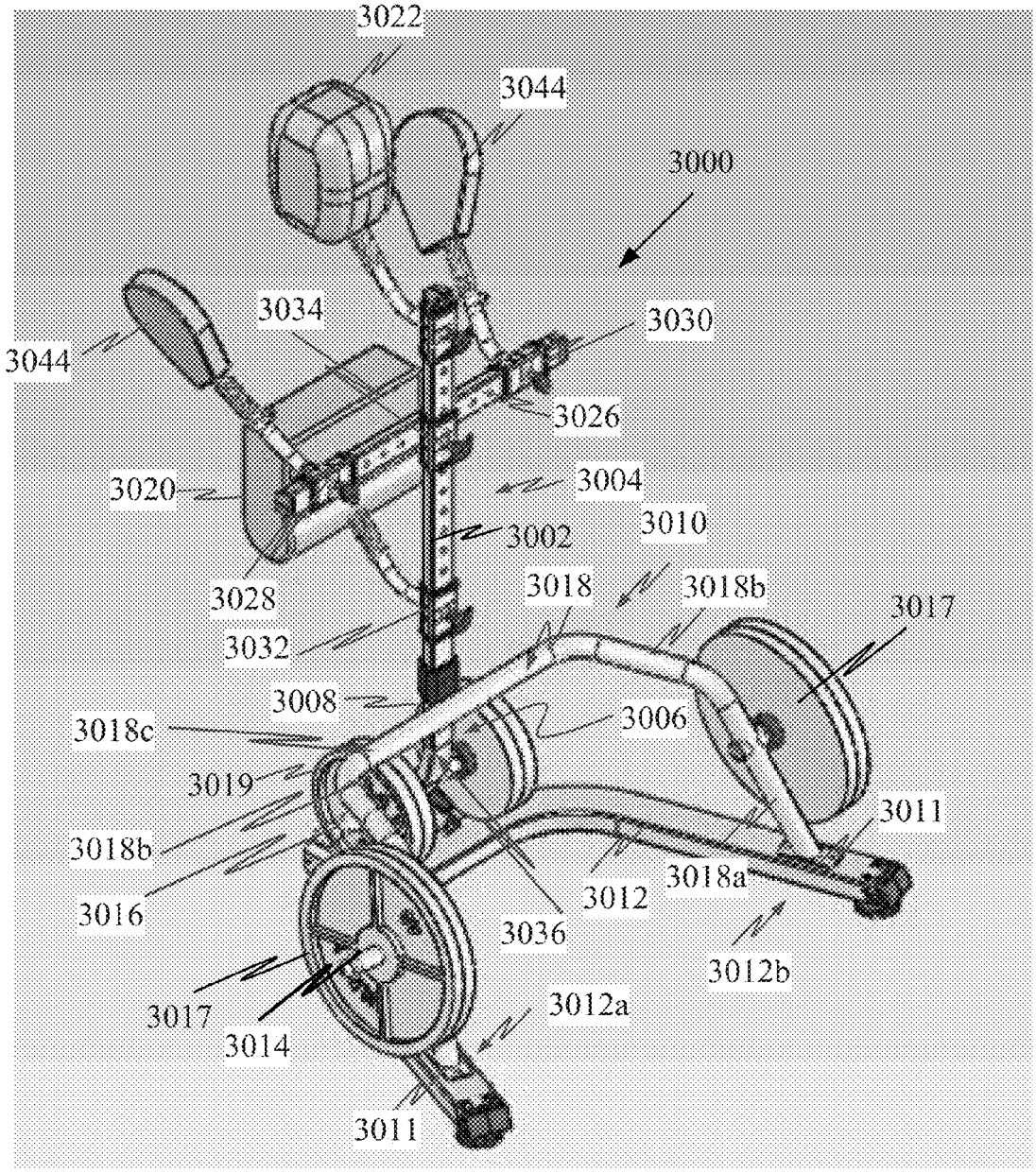
FIG. 30 illustrates a side perspective view of a training stand with stabilizing weights according to an embodiment of the invention.
Figure 31:
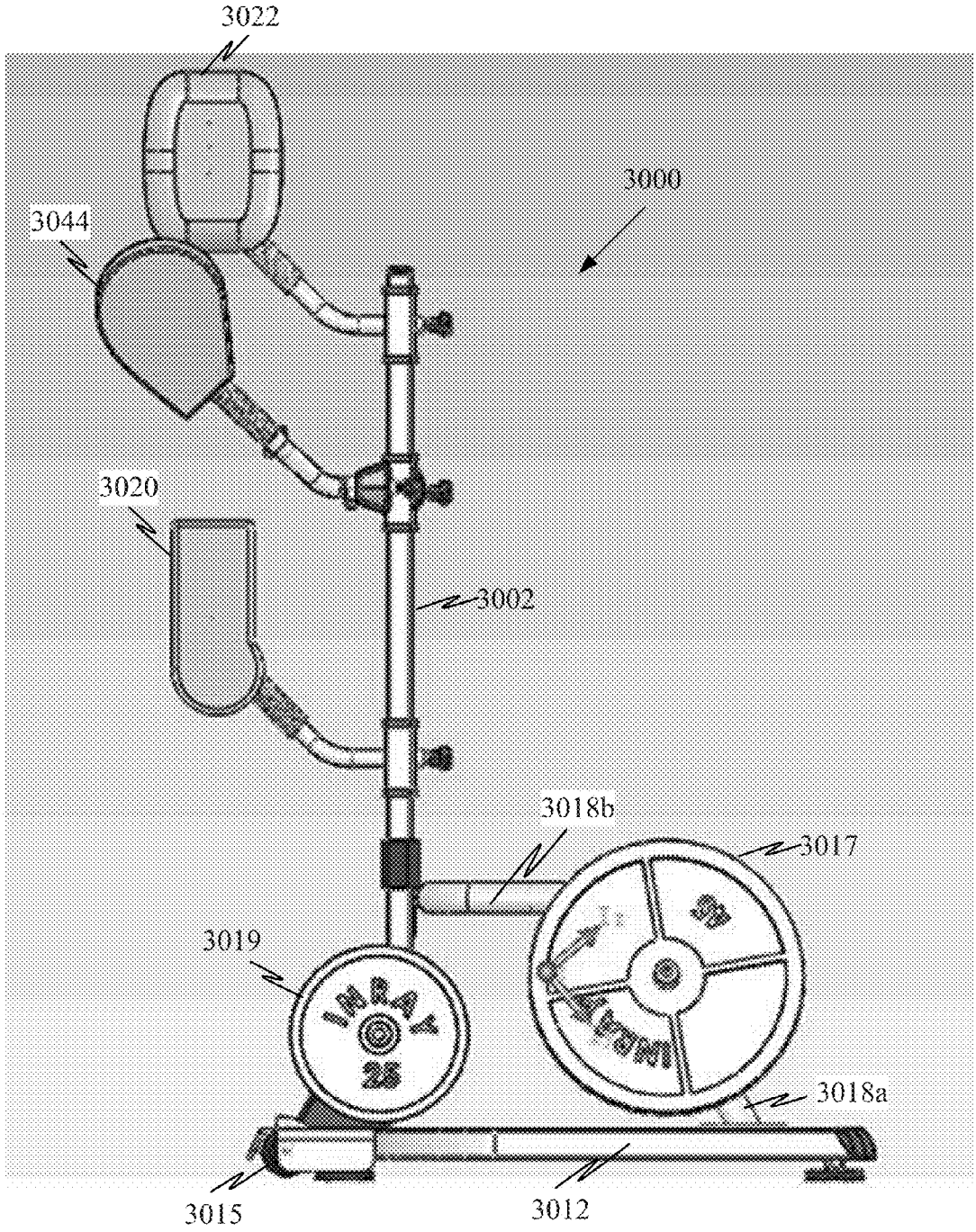
FIG. 31 illustrates a side plan view of the training stand of FIG.30.
Figure 32:
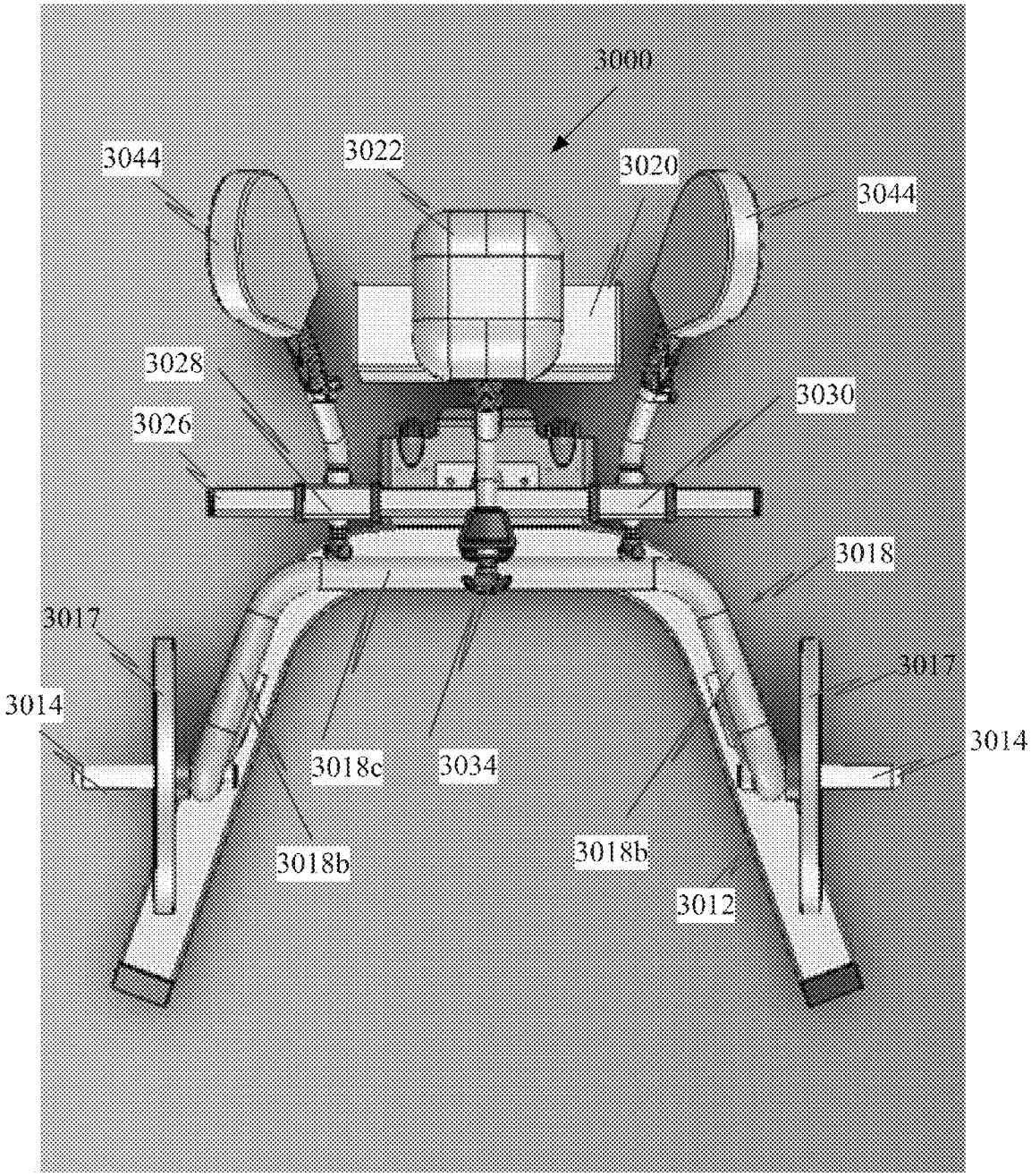
FIG. 32 illustrates a top plan view of the training stand of FIG. 30.

FIGS. 30 through 32 illustrate a training stand 3000 in its upright and usable configuration from different perspectives, according to one embodiment. In FIG. 30, a side perspective view of the training stand having stabilizing weights is illustrated. The training stand 3000 may be formed to at least partially receive a second training stand and may have square tubing or it might have some other tubing shape such as round or rectangular, for example.

The training stand 3000 may include a central frame member, i.e., a central support shaft 3002 comprising an upper portion 3004 and a lower portion 3006 joined at a coupling point 3008. A base 3010 may be operatively coupled to the central support shaft 3002 and may include a U-shaped or V-shaped base member 3012 and a support member 3018 connected to and extend upwardly from a first end portion 3012*a* and a second end portion 3012*b* of the base member 3012, at an angle of approximately 45 degrees or less, to the central frame member.

The support member 3018 may be integrally connected to, or releasably secured to the U-shaped or V-shaped base member 3012 by securing members 3011, including but not limited to bolts or screws. According to one embodiment, the support member 3018 may have a polygonal shape that may be formed from a single piece of tubing or alternatively, the support member 3018 may be formed by a pair of lower side supports 3018*a* connected to a pair of upper side supports 3018*b* where the pair of upper side supports 3018*b* is connected to a top support member 3018*c*. The pair of upper side supports 3018*b* may extend outwardly at a slight angle from the top support member and the pair of upper side supports 3018*b* and the top support member 3018*c* may be located in a horizontal plane. Each of the pair of lower side supports 3018*a* may be integrally connected to one of the upper side supports and extend downwardly at an angle of approximately 45 degrees to the U-shaped or V-shaped base member 3012.

The support member 3018 may serve to couple the central support shaft 3002 and the U-shaped or V-shaped bottom base member 3012 in a fixed position. According to one embodiment, one or more wheels 3015 may be fixedly secured to a front portion of the U-shaped or V-shaped bottom base member 3012 to permit tilting and rolling (i.e. portability) of the training stand 3000.

The central frame member and base 3010 of the training stand 3000 may be formed to at least partially receive the central frame member and base of a second training stand allowing for the nestability of a plurality of the training stands. This nestability reduces the storage space necessary for multiple training stands.

One or more upper weight support pins 3014 and/or one or more lower weight support pins 3016 may be provided onto which weights 3017, 3019 may be added to provide stability to the training stand 3000. The one or more upper weight support pins 3014 may be fixed or removably secured to and extend outwardly from the pair of lower side supports 3018*a* of the support member 3018. In one embodiment, the one or more upper weight support pins 3014 may extend outwardly at a slightly upward angle (e.g. in a horizontal plane) to maintain the weights on the support pins 3014. The one or more lower weight support pins 3016 may be fixed or removably secured to and extend outwardly from the lower portion 3006 of the central support shaft 3002. In one embodiment, the one or more lower support pins 3016 may extend outwardly at a slightly upward angle (e.g. in a horizontal plane) to maintain the weights on the support pins 3016. In some implementations, just the one or more upper weight support pins 3014 and weights 3017 may be utilized. In other implementations, just the one or more lower weight support pins 3016 and weights 3019 may be utilized.

The training stand 3000 may also include a plurality of strike pads coupled along the central support shaft 3002. For instance, a torso pad 3020, a head pad 3022, and two focus pads 3044 may be adjustable coupled to the central support shaft 3004 so that the height of these pads (e.g., relative to the ground and to each other) may be adjusted according to the user. Additionally, a horizontal support shaft 3026 may be coupled to the central support shaft 3002 and the focus pads 3044 may be coupled to the horizontal support shaft 3026. The focus pads 3024 may be slidably adjustable. The pads 3020, 3022, and/or 3024 may include fasteners 3028, 3030, 3032 that engage preset openings/holes along the horizontal support shaft 3026 and/or central support shaft 3002.

As shown in FIG. 30, the lower portion 3006 of the central support shaft 3002 may include a bend 3036. This bend 3036 may serves to shift the center of gravity back, thereby providing greater stability to the training stand 3000.

One advantage of the training devices described above is that each pad, target and connector may be easily removed from the stand for storage through the use of quick release connectors or other easy to actuate clamping or pin mechanisms.

One or more of the components and functions illustrated in the FIGS. may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A training stand, comprising:

a central frame member having an upper portion and a lower portion;

a base operatively coupled to the lower portion of the central frame member, the base comprising:

a U-shaped or V-shaped base member having a first end portion and a second end portion; and a support member connected to and extending upwardly, at an angle of approximately 45 degrees or less, from the first and second end portions of the base member to the central frame member; and one or more upper weight support pins coupled to the support member and extending outward from the training stand; and wherein the central frame support includes a bend between a first point where it couples to the U-shaped or V-shaped base member and a second point where it couples to the pair of side supports.

2. The training stand of claim 1, wherein the support member comprises:

a pair of side supports, the pair of side supports connected to the first and second end portions of the base member; and a top support member integrally connected to the pair of side supports and coupled to the central frame member.

3. The training stand of claim 2, further comprising:

one or more lower weight support pins coupled to the central frame member between the U-shaped or V-shaped base member and the pair of side supports.

4. The training stand of claim 1, wherein the bend shifts the center of gravity of the training stand backwards.

5. The training stand of claim 1, further comprising:

one or more wheels coupled to a front portion of the U-shaped or V-shaped base member that permits tilting and rolling of the training stand.

6. The training stand of claim 1, further comprising a horizontal support shaft coupled to the central support shaft.

7. The training stand of claim 6, further comprising a plurality of strike pads movably coupled to the horizontal support shaft.

8. The training stand of claim 6, wherein the horizontal shaft serves to support one or more adjustable focus pads.

9. The training stand of claim 1, wherein the support member has the same or similar shape as the base member.

10. The training stand of claim 1, wherein the central frame member and the base are formed to at least partially receive a second central frame member and a second base of a second training stand allowing for nesting a plurality of training stands.

11. A training stand, comprising:

a central frame member having an upper portion and a lower portion;

a base operatively coupled to the lower portion of the central frame member, the base comprising:

a U-shaped or V-shaped base member having a first end portion and a second end portion; and a support member connected to and extending upwardly from the first and second end portions of the base member to the central frame member, the support member comprising:

a pair of side supports, the pair of side supports connected to the first and second end portions of the base member; and a top support member integrally connected to the pair of side supports and coupled to the central frame member; and one or more upper weight support pins coupled to the pair of side supports of the support member and extending outward from the training stand; and wherein the central frame member and the base are formed to at least partially receive a second central frame member and a second base of a second training stand allowing for nesting a plurality of training stands; and wherein the central frame support includes a bend between a first point where it couples to the U-shaped or V-shaped base member and a second point where it couples to the pair of side supports.

12. The training stand of claim 11, further comprising:

one or more lower weight support pins coupled to the central frame member between the U-shaped or V-shaped base member and the pair of side supports.

13. The training stand of claim 11, wherein the bend shifts the center of gravity of the training stand backwards.

14. The training stand of claim 11, further comprising:

one or more wheels coupled to a front portion of the U-shaped or V-shaped base member that permits tilting and rolling of the training stand.

15. The training stand of claim 11, further comprising:

a plurality of strike pads movably coupled to the central frame member.

16. The training stand of claim 11, further comprising:

a horizontal shaft coupled to the central frame member and serving to support a one or more adjustable focus pads.

17. The training stand of claim 11, wherein the support member has the same or similar shape as the base member.

18. A training stand, comprising:

a central frame member having an upper portion and a lower portion;

a base operatively coupled to the lower portion of the central frame member, the base comprising:

a U-shaped or V-shaped base member having a first end portion and a second end portion; and a support member connected to and extending upwardly from the first and second end portions of the base member to the central frame member, the support member comprises:

a pair of side supports connected to the first and second end portions of the base member; and a top support member integrally connected to the pair of side supports and coupled to the central frame member.

19. The training stand of claim 18, wherein the top support member extends horizontally outwards from the central frame member.

* * * * *